US011007421B2

(12) United States Patent
Pfeifer et al.

(10) Patent No.: US 11,007,421 B2
(45) **Date of Patent: *May 18, 2021**

(54) SNOW SKI ASSEMBLIES

(71) Applicants: John Pfeifer, Kirkwood, MO (US); Michael C. Marner, Tucson, AZ (US)

(72) Inventors: John Pfeifer, Kirkwood, MO (US); Michael C. Marner, Tucson, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/891,104

(22) Filed: Feb. 7, 2018

(65) Prior Publication Data

US 2018/0207510 A1 Jul. 26, 2018

Related U.S. Application Data

(63) Continuation of application No. 14/579,170, filed on Dec. 22, 2014, now Pat. No. 9,950,241.

(51) Int. Cl.

| | |
|---|---|
| ***A63C 5/04*** | (2006.01) |
| ***A63C 5/056*** | (2006.01) |
| ***A63C 10/14*** | (2012.01) |
| ***A63C 5/02*** | (2006.01) |
| *A63C 10/04* | (2012.01) |
| *A63C 10/18* | (2012.01) |

(Continued)

(52) U.S. Cl.

CPC ..... *A63C 5/0405* (2013.01); *A63C 5/02* (2013.01); *A63C 5/056* (2013.01); *A63C 10/14* (2013.01); *A63C 10/04* (2013.01); *A63C 10/18* (2013.01); *A63C 10/20* (2013.01); *A63C 10/24* (2013.01)

(58) Field of Classification Search

CPC ..... A63C 5/0405; A63C 5/02; A63C 5/056; A63C 10/14; A63C 10/20; A63C 10/04; A63C 10/18; A63C 10/24

See application file for complete search history.

(56) References Cited

U.S. PATENT DOCUMENTS

| | | | | |
|---|---|---|---|---|
| 34,949 A | | 4/1862 | Dutton | |
| 1,357,940 A | * | 11/1920 | Berry | A47G 19/30 220/574 |

(Continued)

FOREIGN PATENT DOCUMENTS

| | | |
|---|---|---|
| RU | 2338568 C2 | 11/2008 |
| RU | 118281 U1 | 7/2012 |

(Continued)

*Primary Examiner* — Jacob B Meyer

(74) *Attorney, Agent, or Firm* — Harness, Dickey & Pierce, P.L.C.

(57) ABSTRACT

A snow ski assembly is provided for use by an individual to slide across a snow covered surface, for example, under the force of gravity. The assembly includes a ski having a bottom wall for engaging a snow covered surface and an upturned peripheral region extending around a perimeter of the bottom wall to help facilitate sliding movement of the ski across a snow covered surface in any direction, without preference to a particular direction, and to help inhibit the ski from digging into the snow covered surface when sliding across the snow covered surface. The assembly also includes a mounting feature for coupling a binding to the bottom wall of the ski, such that an individual can position a foot in the binding and use the ski to slide across the snow covered surface.

19 Claims, 20 Drawing Sheets

(51) Int. Cl.
*A63C 10/20* (2012.01)
*A63C 10/24* (2012.01)

(56) References Cited

U.S. PATENT DOCUMENTS 2,154,019 A * 4/1939 Westphal ..... A63C 1/00 280/600
2,430,466 A * 11/1947 Hedman ..... A63C 13/001 36/116
D163,316 S 5/1951 Paden
D166,120 S 3/1952 Paden
2,756,517 A * 7/1956 Youtz ..... A43B 5/18 36/7.8
2,762,063 A * 9/1956 Harvie ..... B63B 1/041 280/14.21
2,826,423 A * 3/1958 Erickson ..... B62B 15/00 114/346
2,826,424 A * 3/1958 Erickson ..... B62B 15/00 220/659
2,878,858 A * 3/1959 Winchester ..... A63G 23/00 114/363
2,946,599 A * 7/1960 Hunsbedt ..... A63C 13/001 280/11.3
3,188,087 A * 6/1965 Larson, Jr. ..... A63B 21/0004 273/115
3,306,626 A * 2/1967 Tadao ..... A63B 22/18 280/205
3,423,852 A * 1/1969 Smith ..... A43B 13/20 36/7.5
3,586,321 A * 6/1971 Gehrke ..... A63G 23/00 472/14
3,612,520 A * 10/1971 Chang ..... A63B 21/0004 482/146
3,716,880 A * 2/1973 Sorenson ..... B63B 1/041 441/67
3,950,808 A * 4/1976 Sorenson ..... B63B 1/041 441/67
3,965,586 A * 6/1976 Roosli ..... A43B 5/0419 280/825
4,004,355 A * 1/1977 Koblick ..... A63C 5/02 280/11.3
D256,604 S 8/1980 Arzoian
4,327,504 A * 5/1982 Welsch ..... A63C 13/005 36/122
4,525,941 A * 7/1985 Ruth, Jr. ..... A43B 5/18 36/116
D286,904 S 11/1986 Kim
4,676,009 A * 6/1987 Davis ..... A43B 5/18 36/116
4,687,198 A * 8/1987 Smith ..... A63B 22/14 482/147
4,705,291 A * 11/1987 Gauer ..... A63C 5/00 280/601
4,801,140 A * 1/1989 Bergeron ..... A63B 21/0004 280/87.01
4,836,571 A * 6/1989 Corbisiero ..... A63C 1/26 280/600
5,048,823 A * 9/1991 Bean ..... A63B 21/0004 482/146
5,193,839 A * 3/1993 Hannes ..... A63C 5/00 280/600
5,301,441 A * 4/1994 Kownacki ..... A63B 25/10 36/1
5,398,957 A 3/1995 Leighton et al.
5,643,154 A * 7/1997 Awbrey ..... A63B 21/0004 482/111
D383,824 S 9/1997 Mendoza et al.
5,685,807 A * 11/1997 Tong ..... A63B 25/10 482/75
5,687,983 A * 11/1997 Feketa ..... A63C 5/003 280/608
5,810,703 A * 9/1998 Stack ..... A63B 22/18 482/146
5,897,474 A * 4/1999 Romero ..... A63B 22/14 446/396
5,916,071 A * 6/1999 Lee ..... A43B 13/182 482/124
D412,195 S 7/1999 Falconer
D412,353 S 7/1999 Falconer
5,951,403 A * 9/1999 Trzos ..... A63G 23/00 472/102
6,238,325 B1 * 5/2001 Oxford ..... A63B 21/0004 482/146
6,244,615 B1 * 6/2001 Mendoza ..... A63C 5/03 280/14.21
6,254,111 B1 * 7/2001 Servant ..... A63C 5/03 280/14.22
6,551,225 B1 * 4/2003 Romero ..... A63B 21/0004 482/145
6,575,885 B1 * 6/2003 Weck ..... A63B 21/0004 482/146
6,595,541 B2 * 7/2003 Kuchler ..... A63C 5/00 280/11.36
6,616,583 B1 * 9/2003 Stack ..... A63B 21/0004 482/146
6,729,049 B1 * 5/2004 Hui ..... A43B 3/16 36/116
6,923,751 B2 8/2005 Oxford
7,510,206 B2 * 3/2009 Walker ..... A63C 5/02 280/600
D605,244 S 12/2009 Herkner et al.
8,105,218 B1 * 1/2012 Vayntraub ..... A63B 23/1236 482/141
8,397,404 B2 * 3/2013 Kim ..... A43B 5/00 36/103
8,678,985 B2 * 3/2014 Mattox ..... A63B 21/0004 482/142
8,814,768 B1 * 8/2014 Yang ..... A63B 22/18 482/121
8,939,463 B2 * 1/2015 Mendoza ..... A63C 5/02 280/600
9,232,829 B2 * 1/2016 Breach ..... A43B 5/0417
D748,752 S 2/2016 Nokes
9,950,241 B2 * 4/2018 Pfeifer ..... A63C 5/0405
2003/0151215 A1 * 8/2003 Stief ..... A63C 5/03 280/14.21
2005/0245372 A1 * 11/2005 Mylrea ..... A63B 21/0004 482/148
2006/0097484 A1 5/2006 Walker
2011/0079986 A1 * 4/2011 Gradman ..... A63C 5/02 280/609
2013/0015638 A1 1/2013 Mendoza
2016/0175686 A1 * 6/2016 Pfeifer ..... A63C 5/0405 280/607

FOREIGN PATENT DOCUMENTS

SU 679214 A1 8/1979
WO WO-2016106143 A2 6/2016

* cited by examiner

SNOW SKI ASSEMBLIES

CROSS-REFERENCE TO RELATED APPLICATION

This application is a continuation of U.S. patent application Ser. No. 14/579,170, filed on Dec. 22, 2014. The entire disclosure of the above application is incorporated herein by reference.

FIELD

The present disclosure generally relates to snow ski assemblies for use by individuals to slide across snow or ice in any direction.

BACKGROUND

This section provides background information related to the present disclosure which is not necessarily prior art.

Snow skis are often used by individuals to slide across snow. Typically, the snow skis are long, narrow and rectangular in shape, and allow for movement in only a generally forward direction. Sides of the snow skis are then formed with edges to help the individuals wearing the snow skis turn and stop.

SUMMARY

This section provides a general summary of the disclosure, and is not a comprehensive disclosure of its full scope or all of its features.

Exemplary embodiments of the present disclosure generally relate to snow ski assemblies for use by individuals to slide across snow covered surfaces, for example, under the force of gravity, etc. In one exemplary embodiment, such a snow ski assembly generally includes a ski and a mounting feature. The ski has a bottom wall for engaging a snow covered surface and an upturned peripheral region extending generally around the bottom wall to help facilitate sliding movement of the ski across a snow covered surface in any direction, without preference to a particular direction, and to help inhibit the ski from digging into the snow covered surface when sliding across the snow covered surface. And, the mounting feature is configured for coupling a binding to the ski, such that an individual can position a foot in the binding and use the ski to slide across the snow covered surface.

In another exemplary embodiment, a ski of a snow ski assembly generally includes an upturned peripheral region extending around the ski to help facilitate sliding movement of the ski across a snow covered surface in any direction, without preference to a particular direction, and to help inhibit the ski from digging into the snow covered surface when sliding across the snow covered surface. The ski also includes a mounting feature for use in positioning a single foot of an individual on the ski, so that the individual can stand on the ski and slide across a snow covered surface under the force of gravity.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 7 is a section view of the ski of FIG. 5, taken in a plane including line 7-7 in

Figure 8:
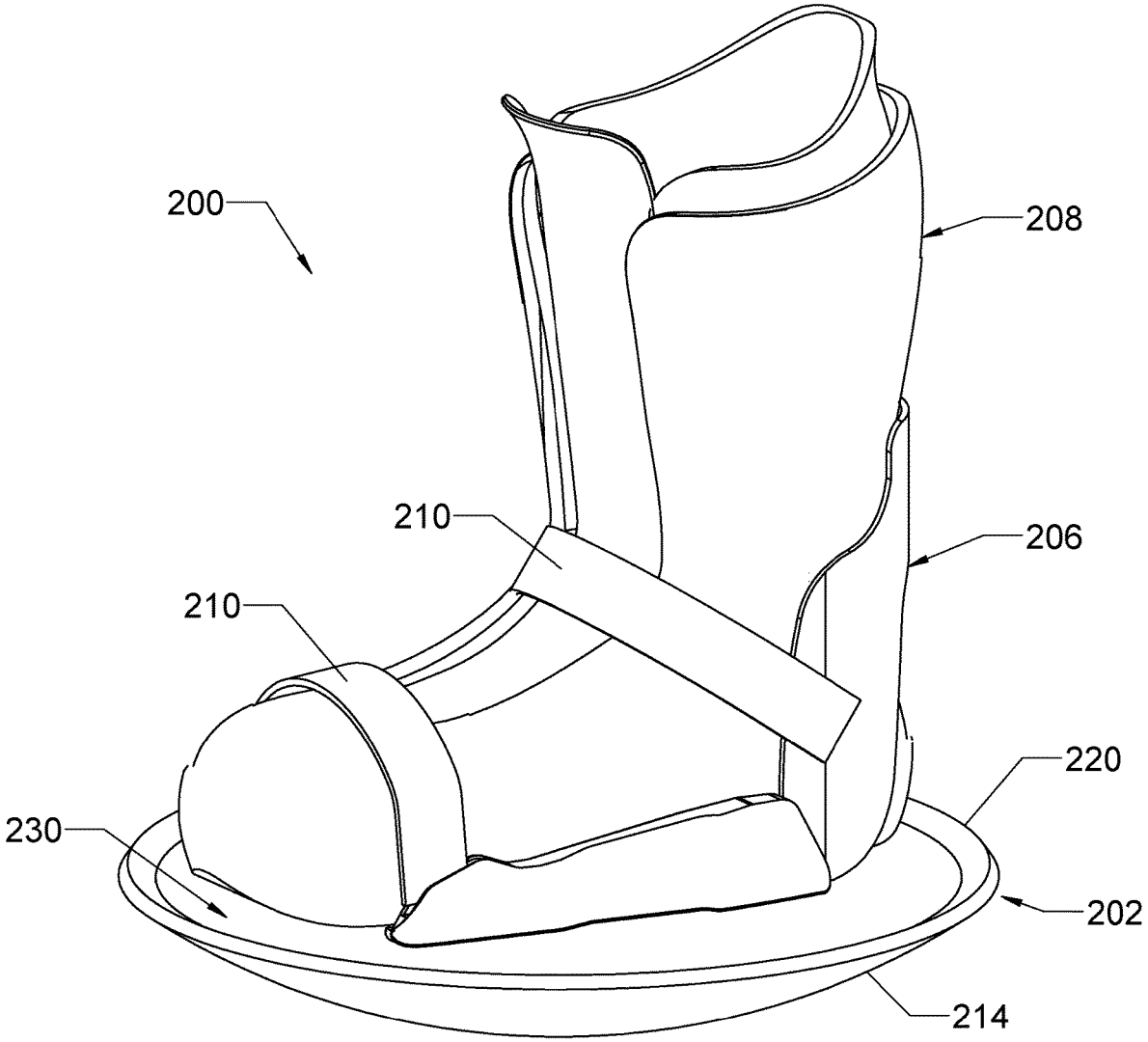
Figure 9:
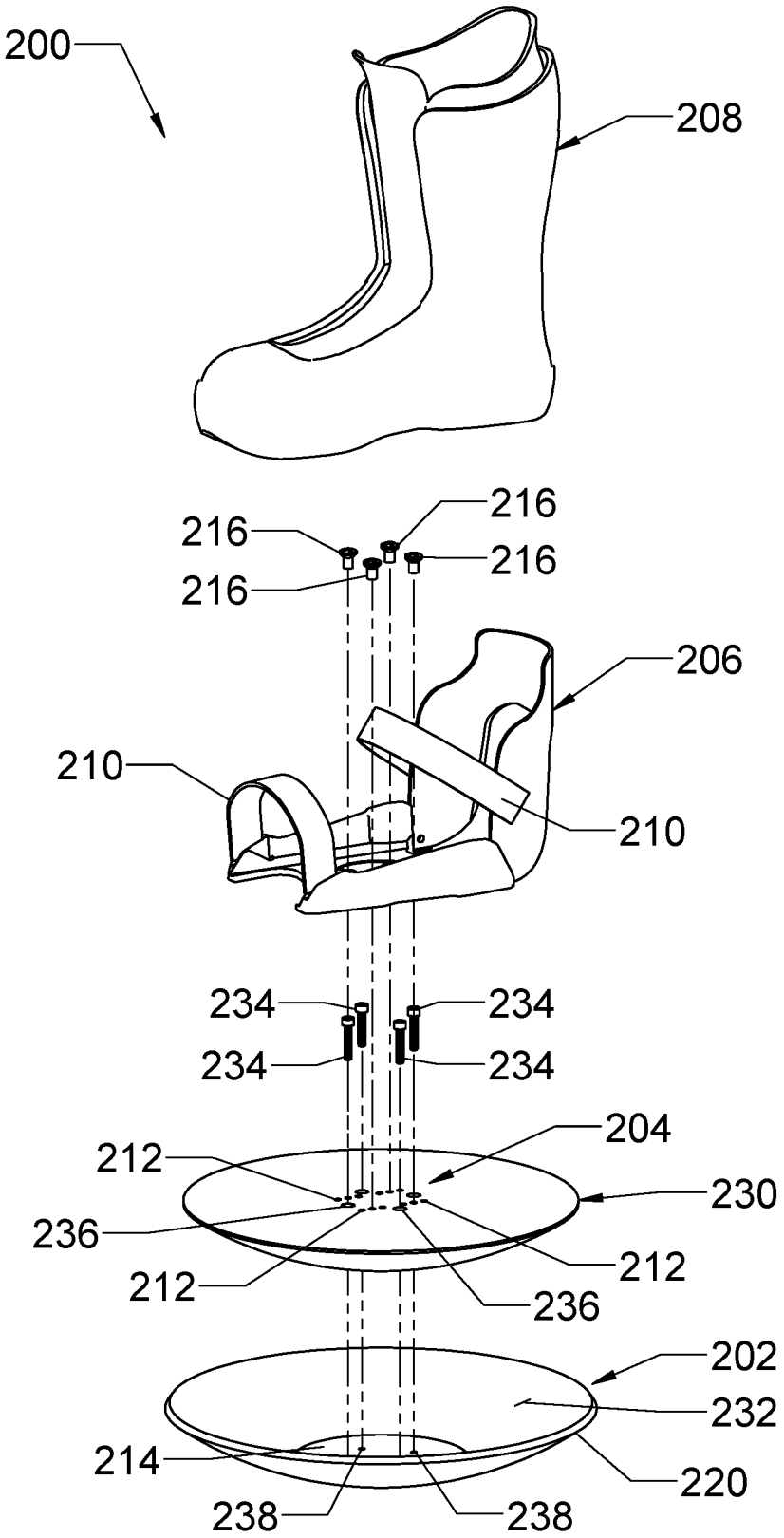
Figure 10:
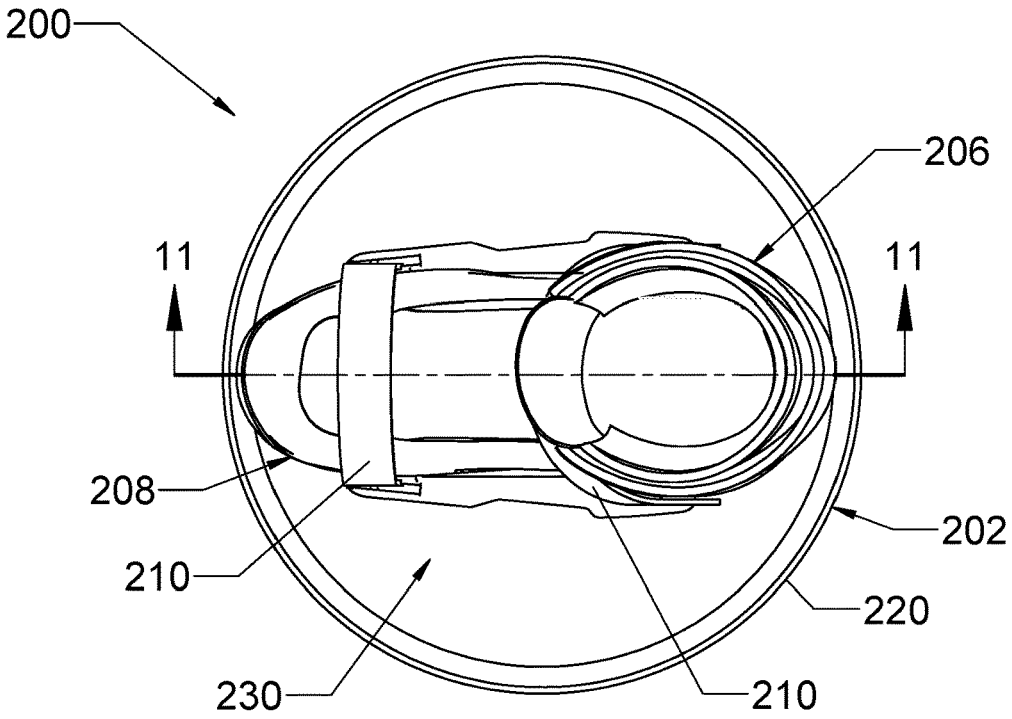
Figure 11:
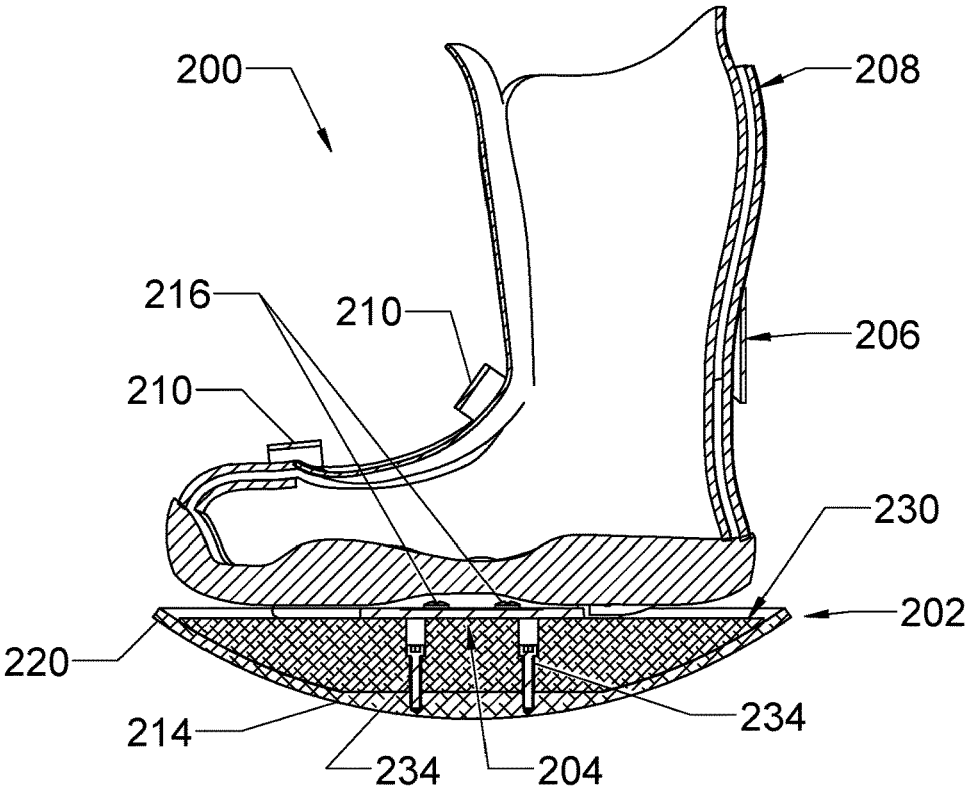
Figure 12:
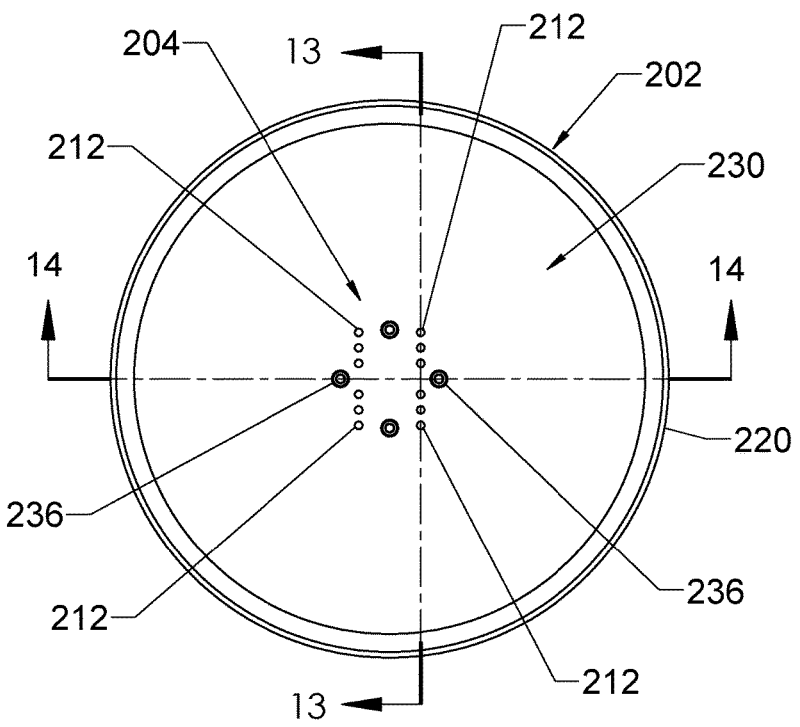
Figure 13:
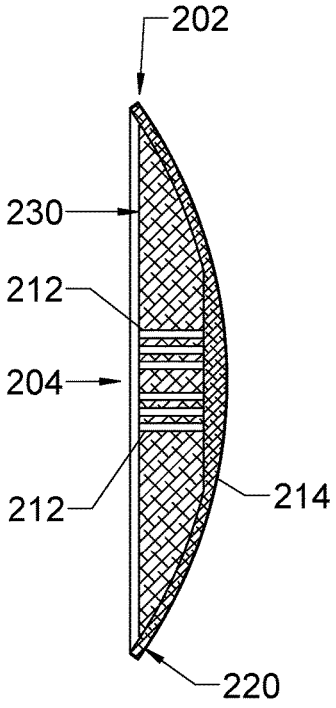
Figure 14:
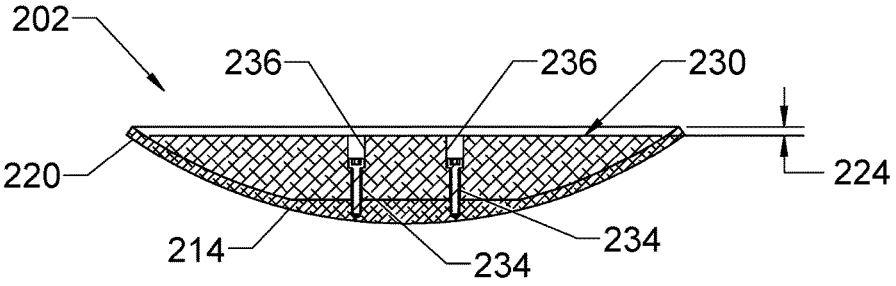
Figure 15:
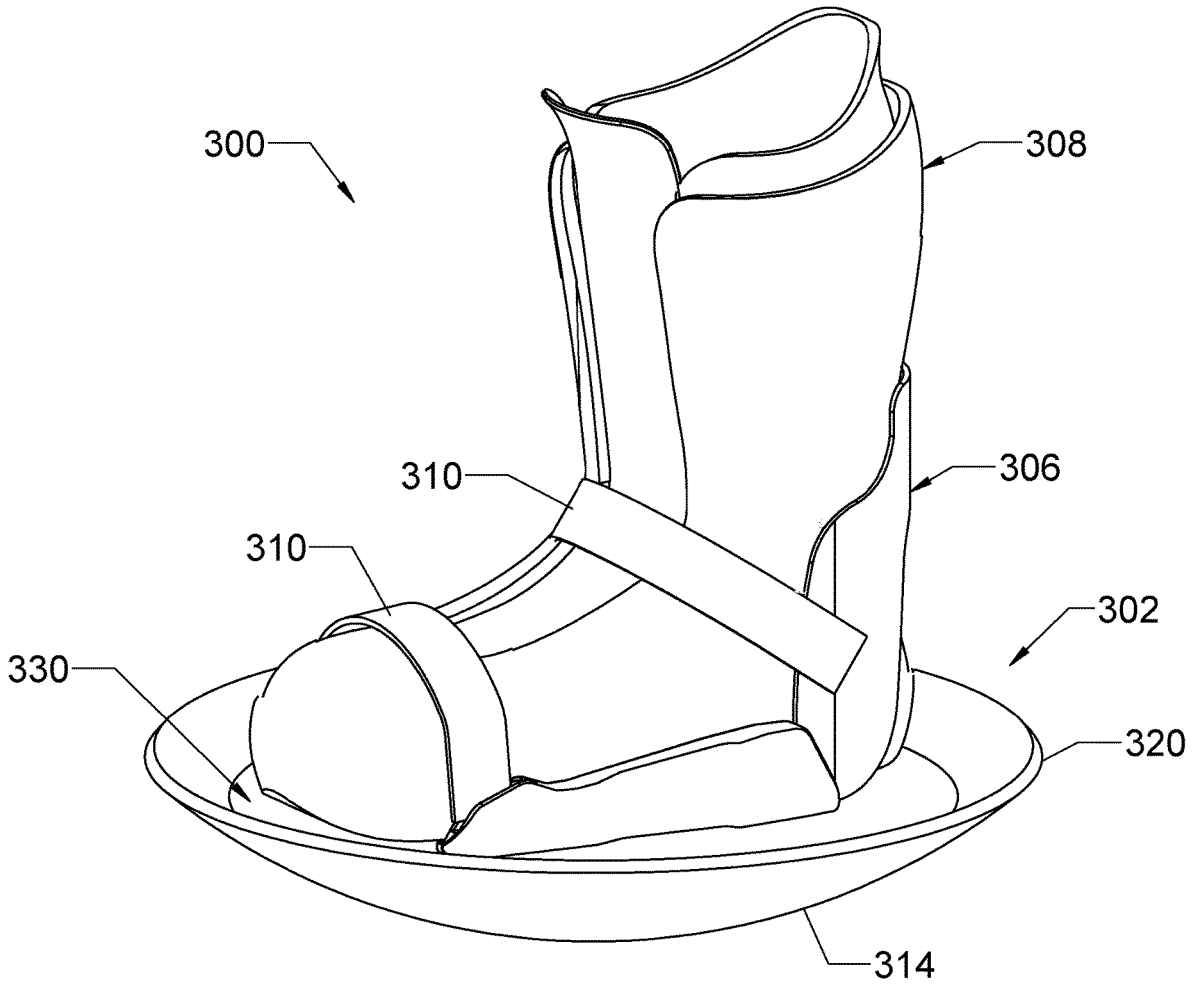
Figure 16:
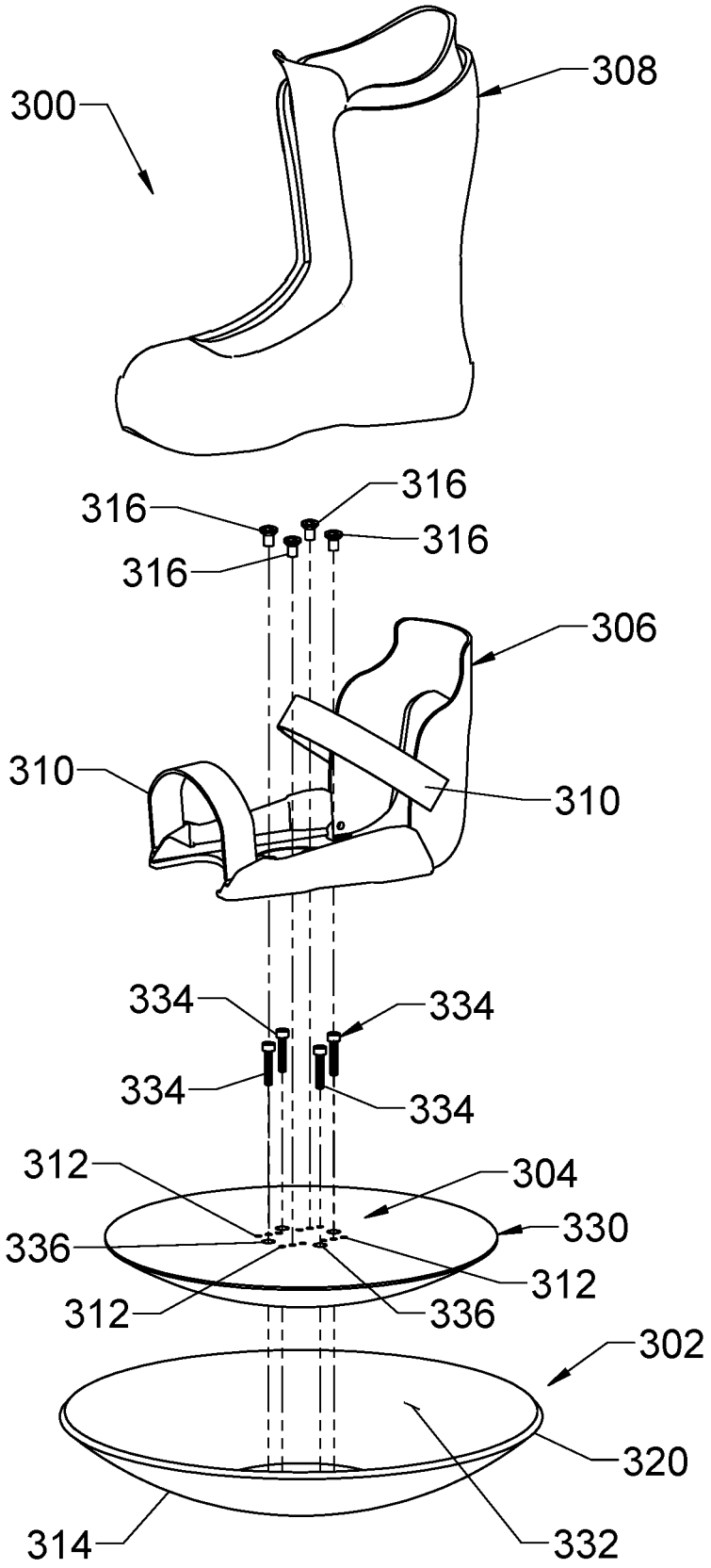
Figure 17:
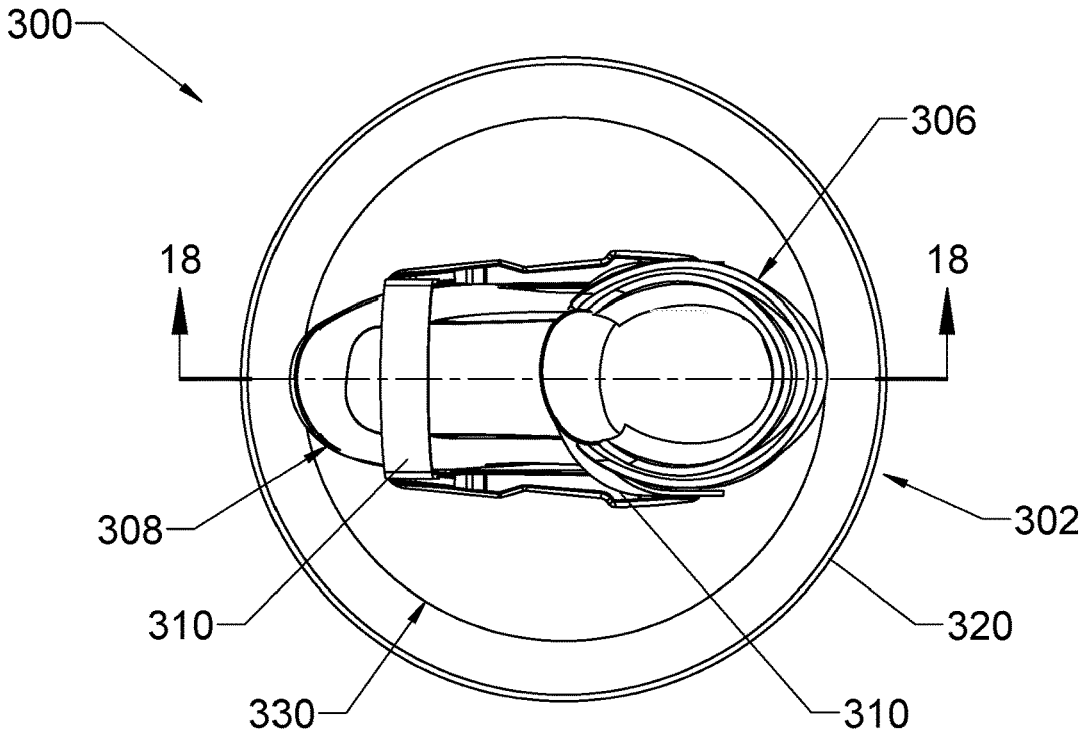
Figure 18:
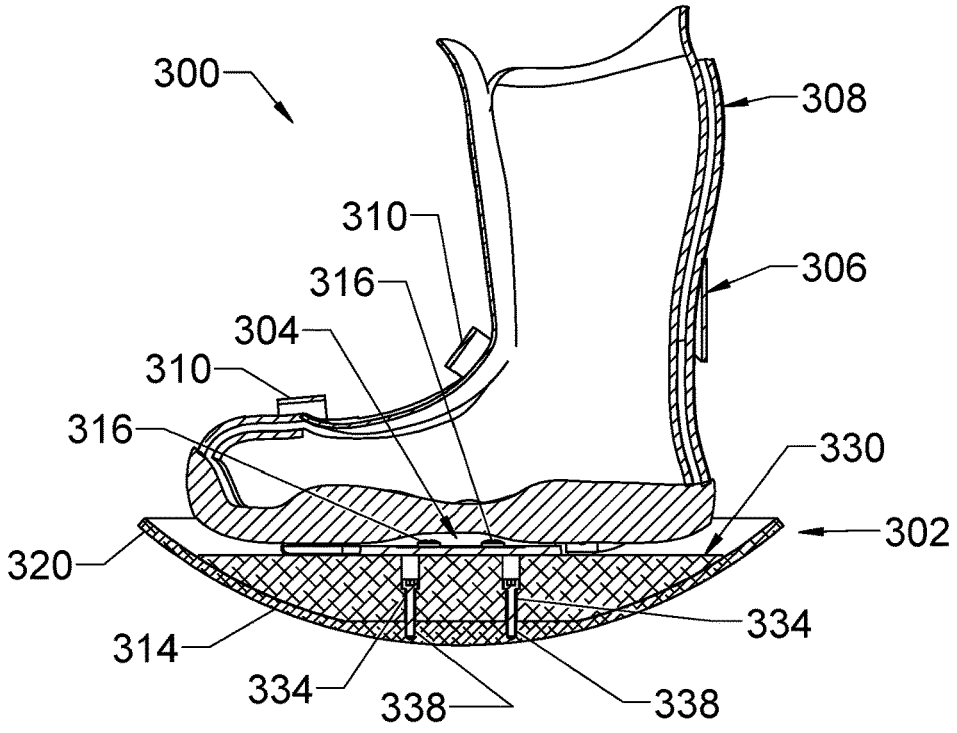
Figure 19:
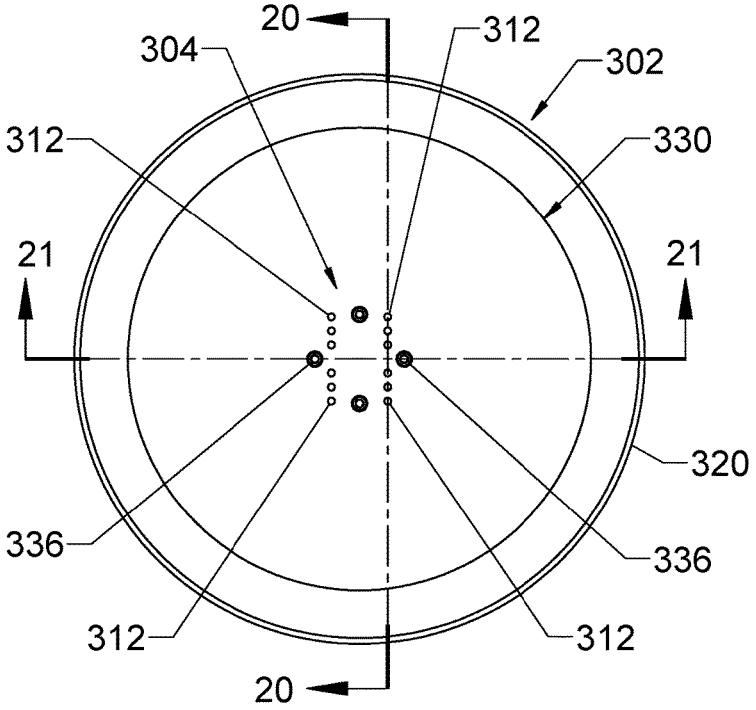
Figure 20:
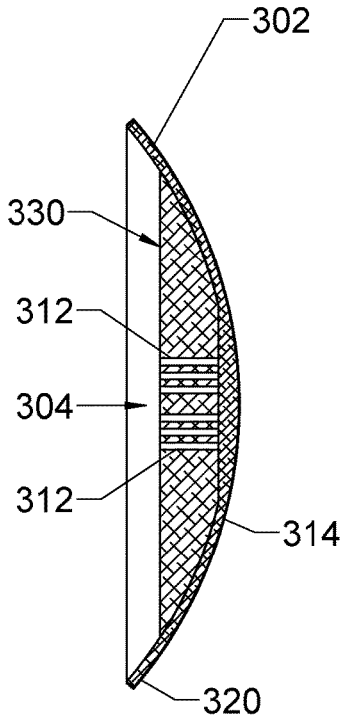
Figure 21:
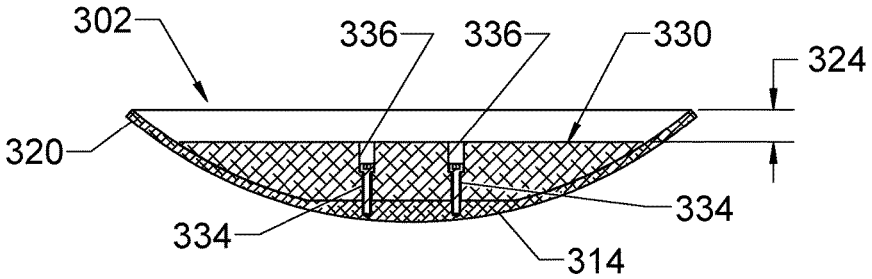
Figure 22:
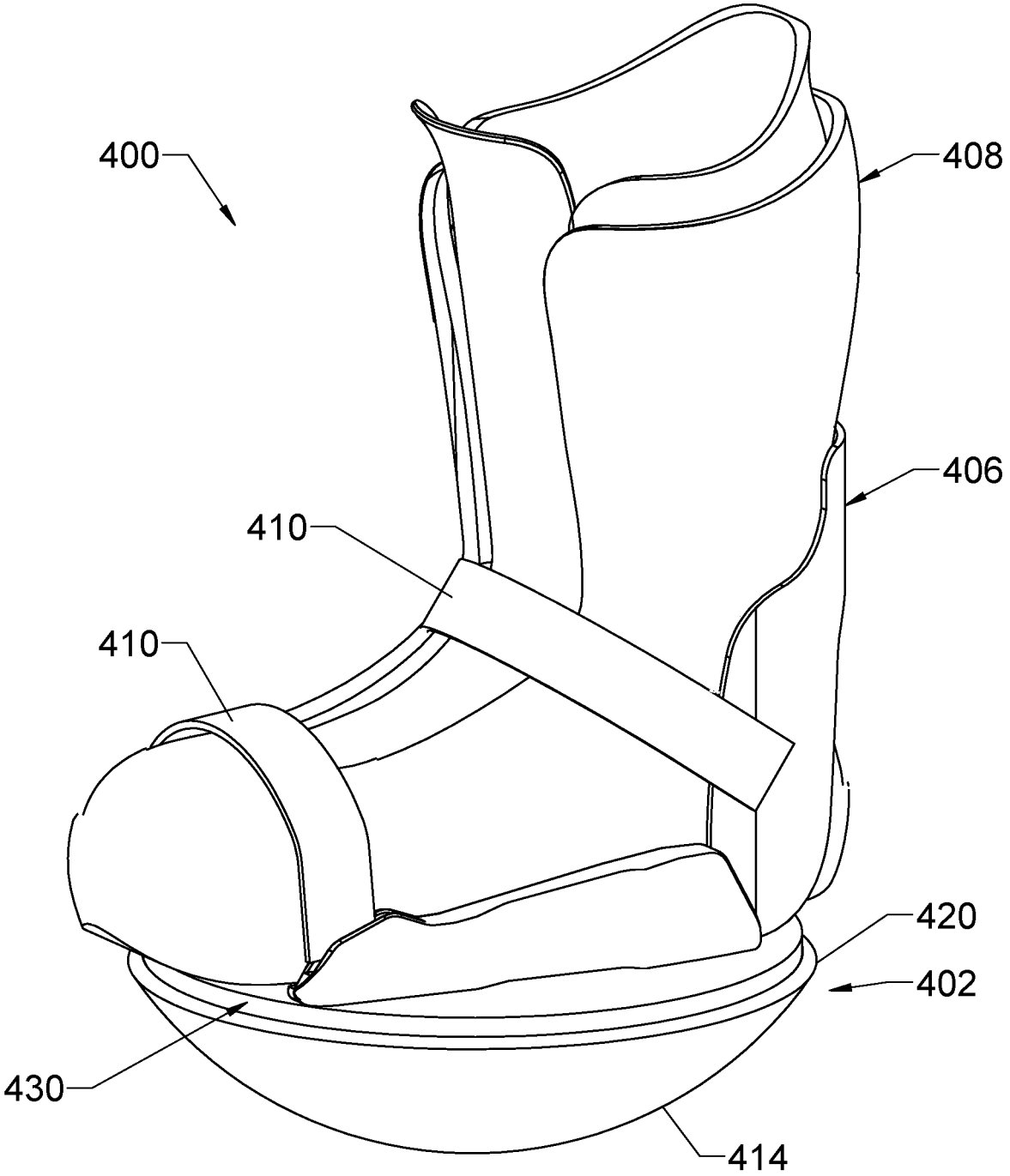
Figure 23:
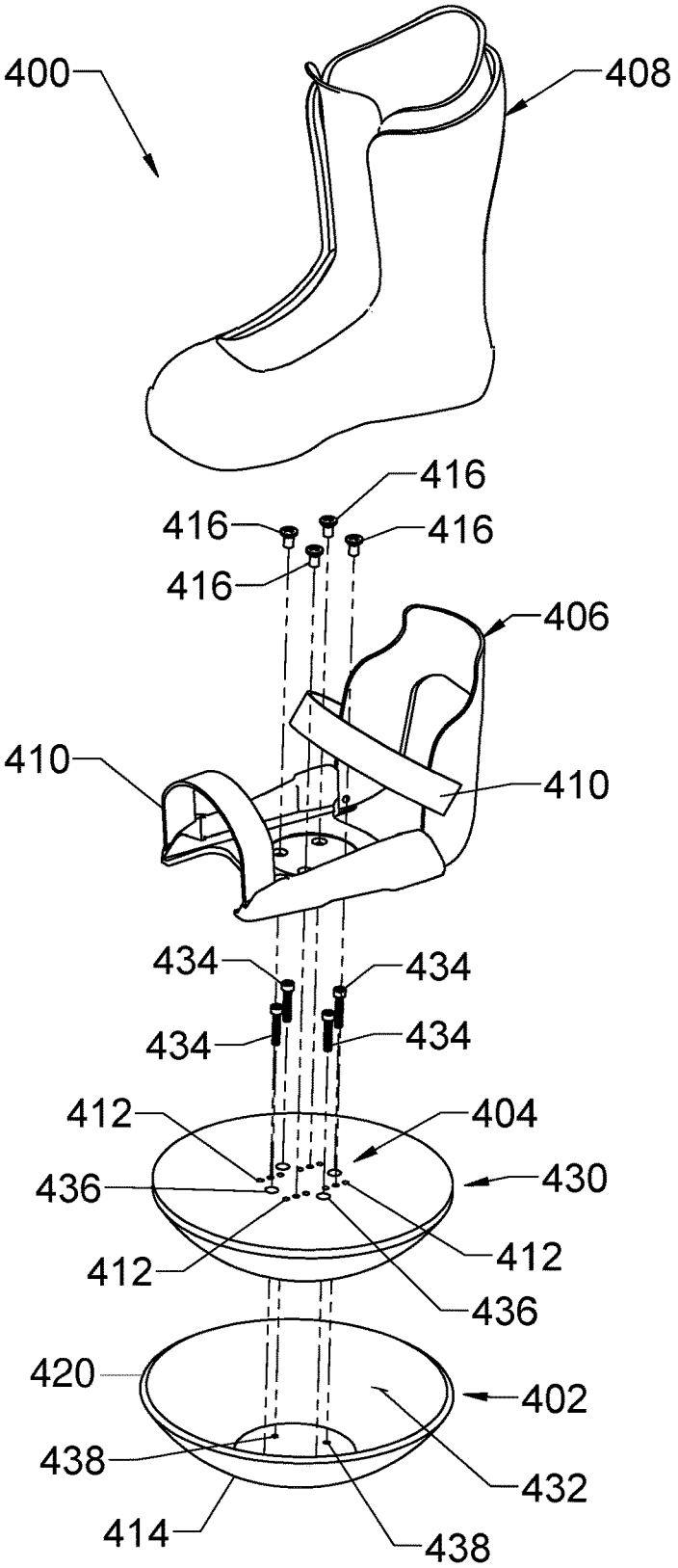
Figure 24:
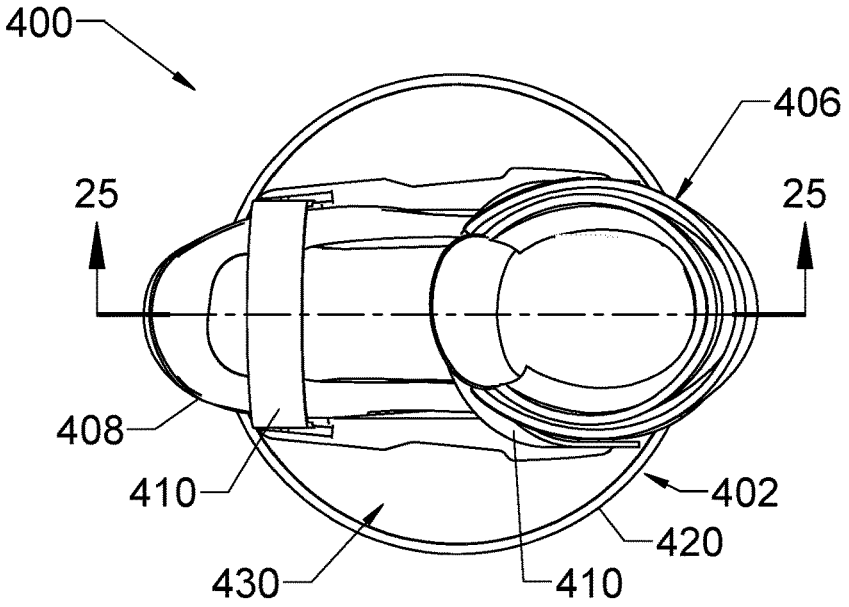
Figure 25:
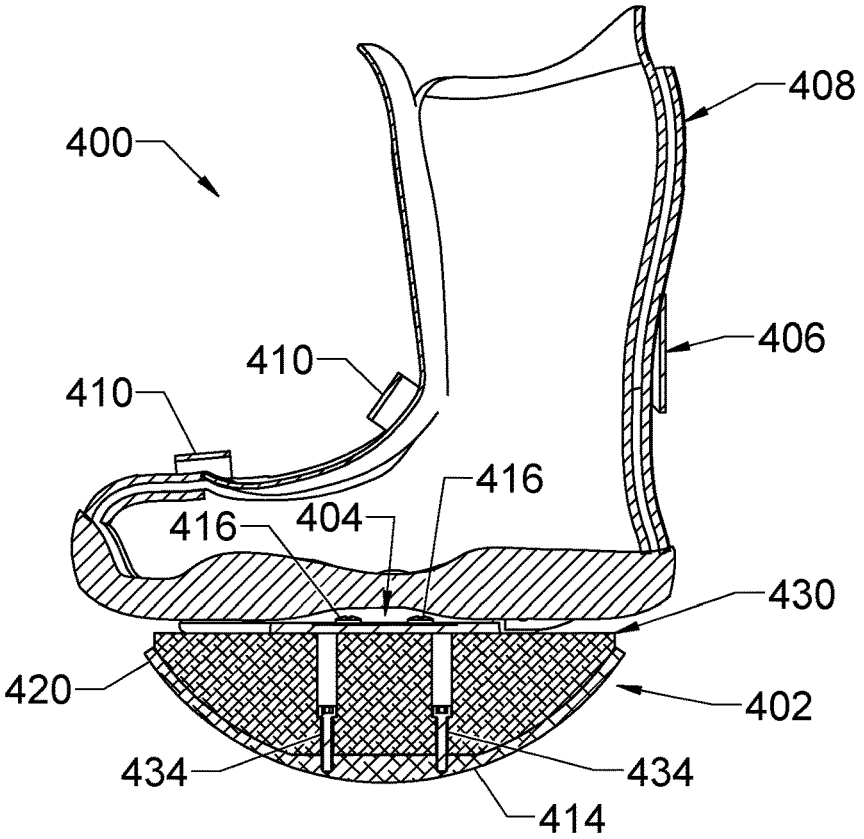
Figure 26:
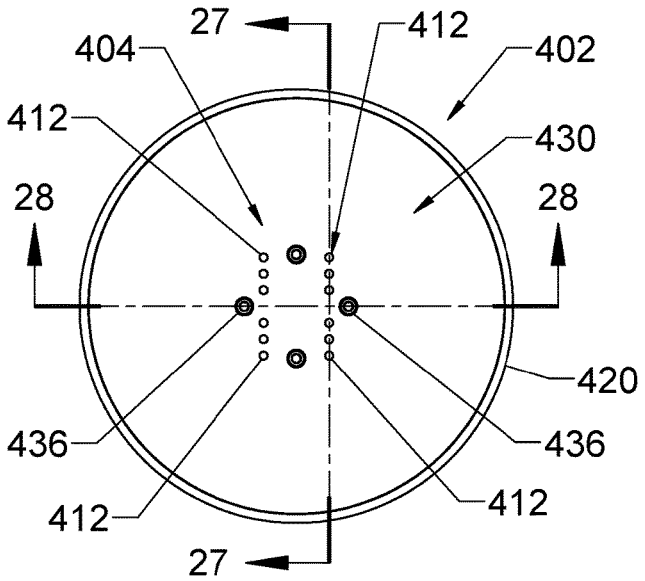
Figure 27:
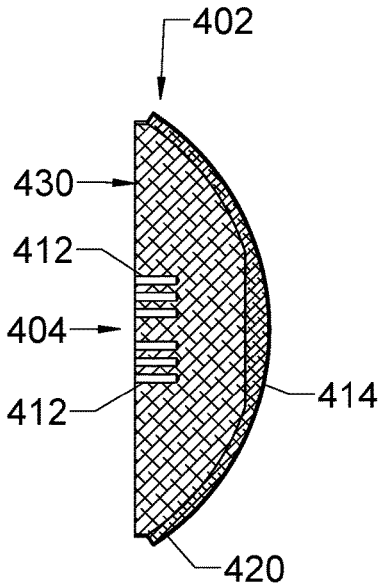
Figure 28:
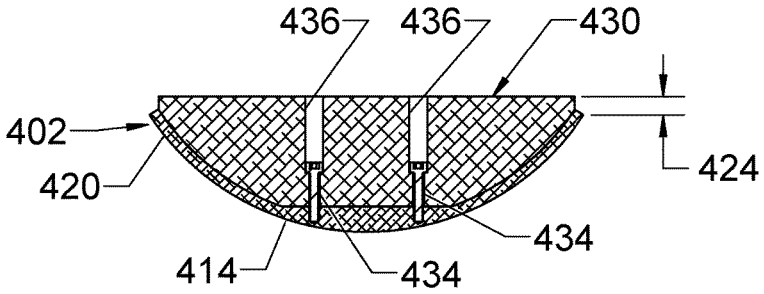
Figure 29:
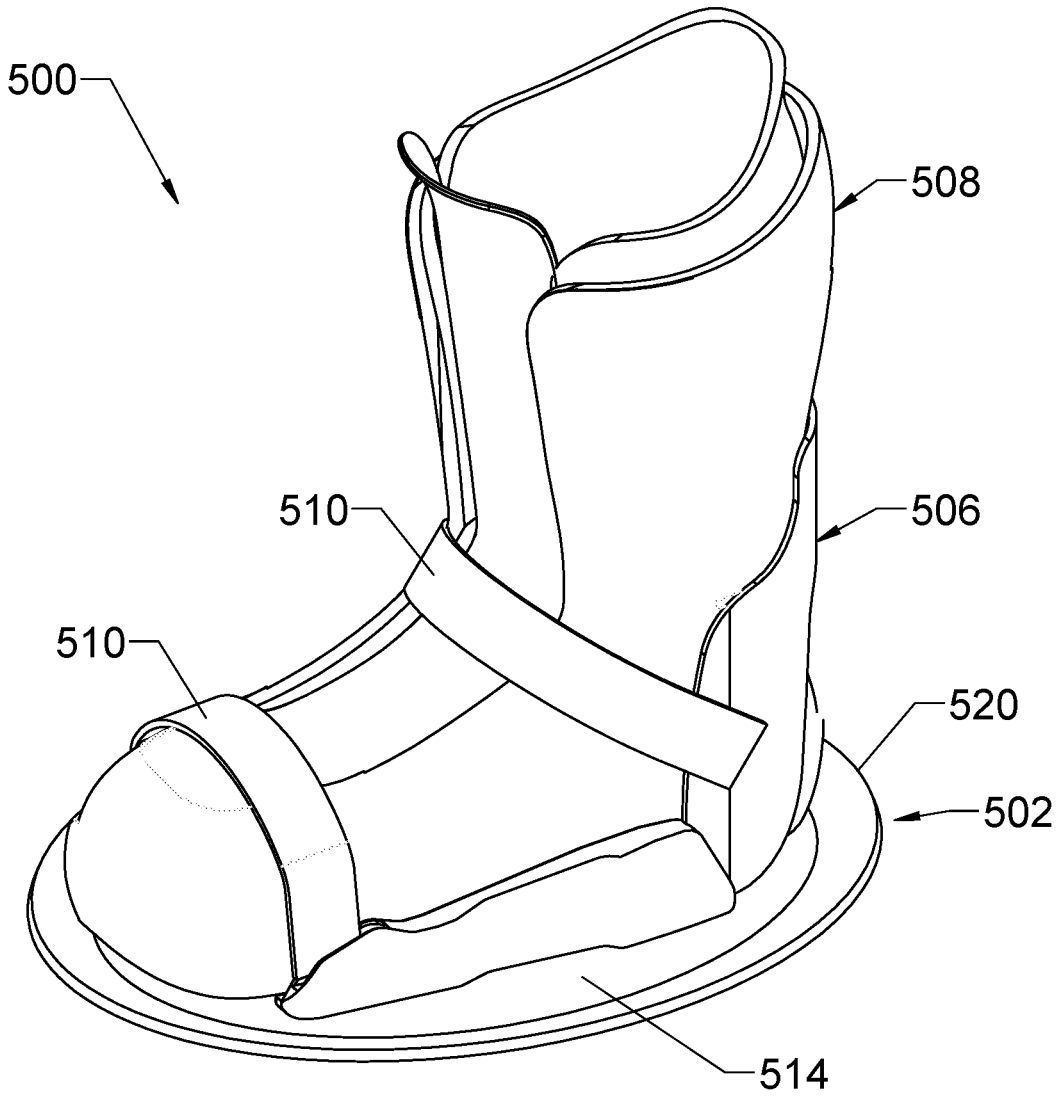
Figure 30:
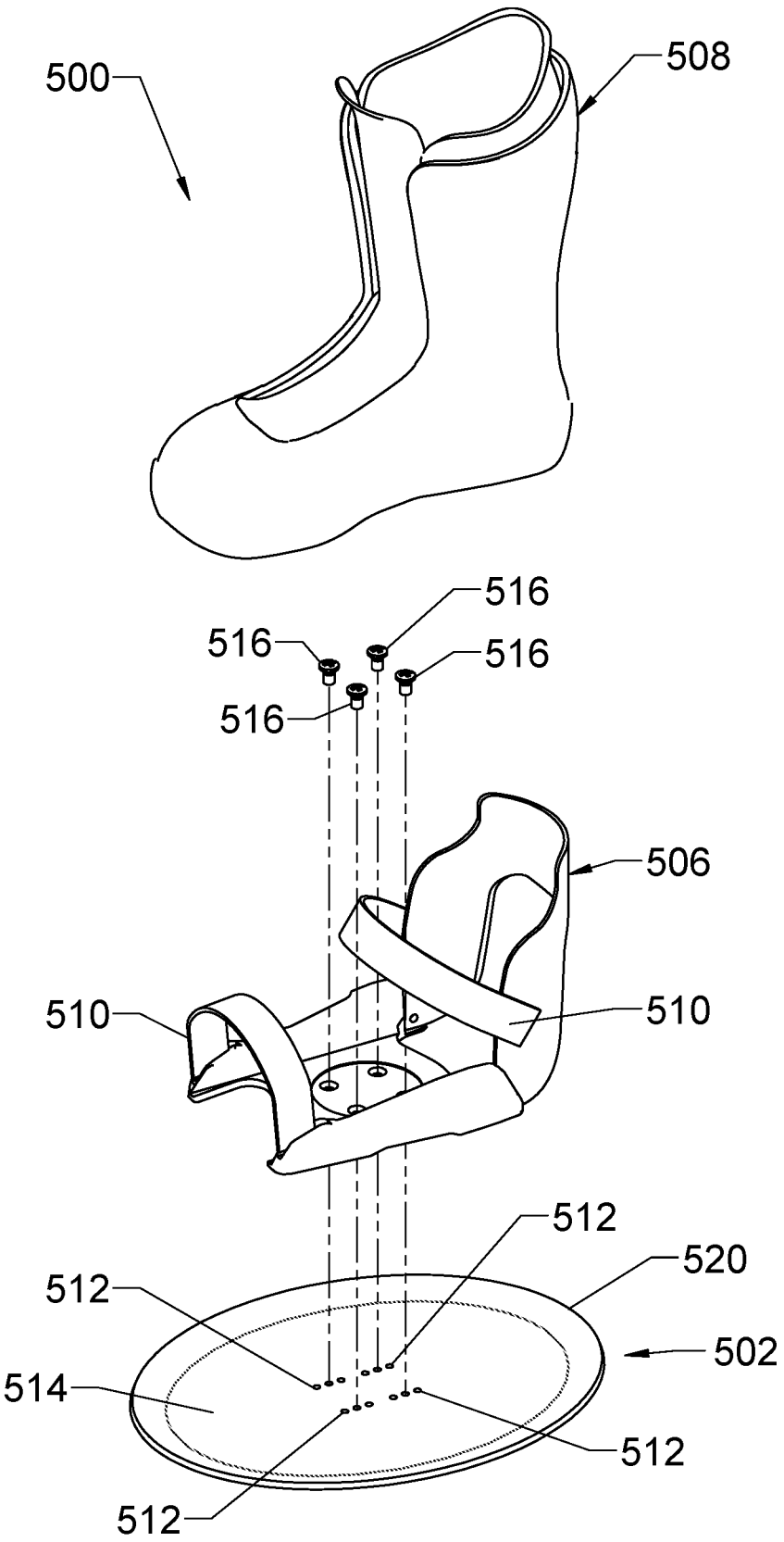
Figure 31:
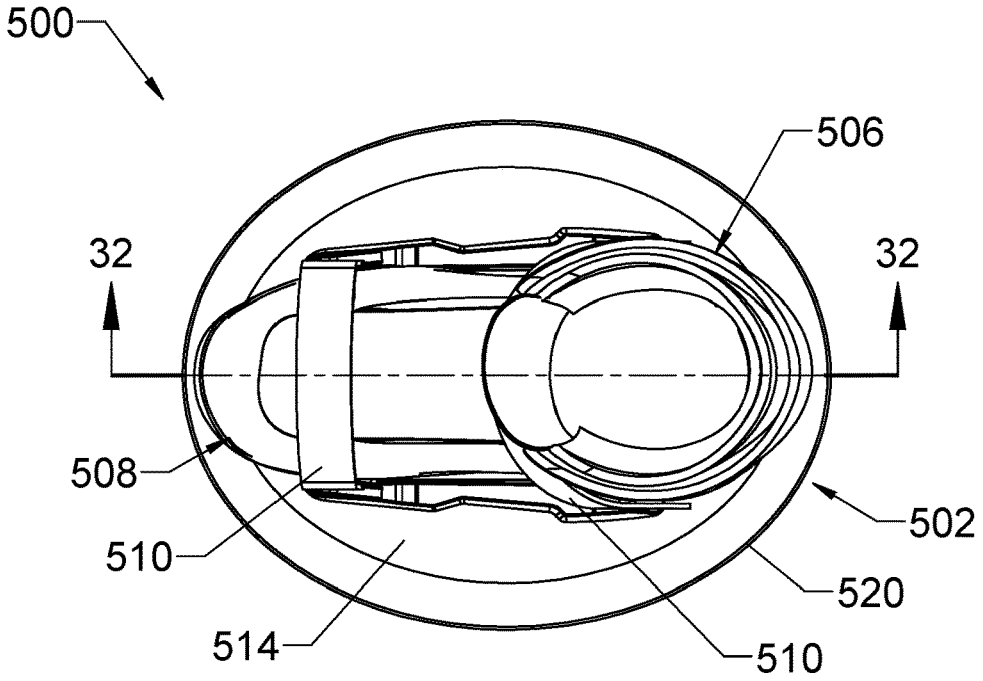
Figure 32:
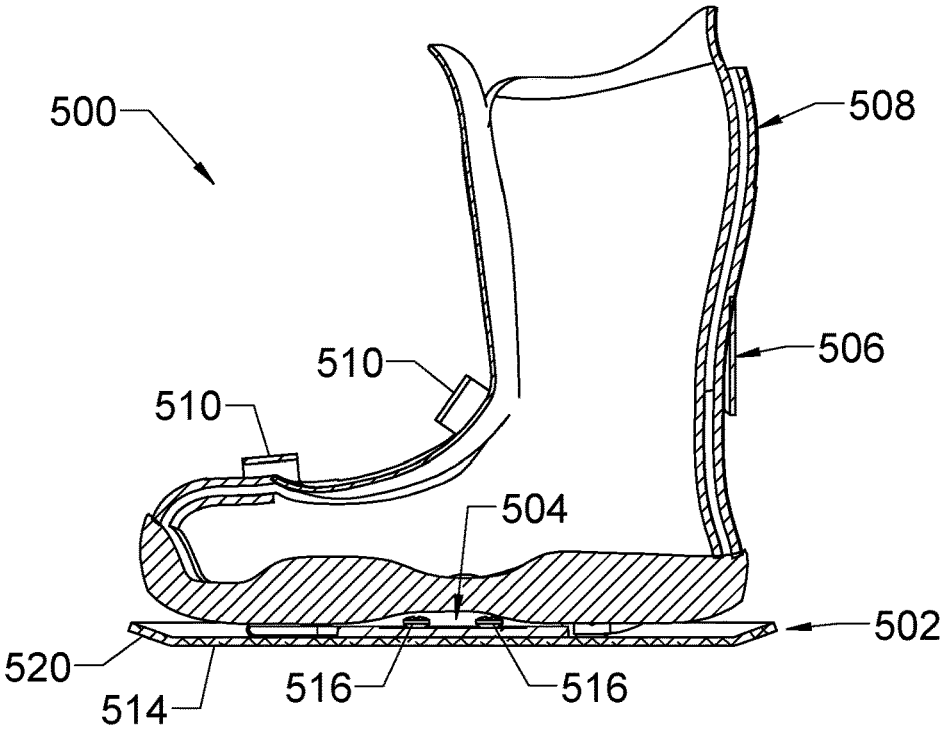
Figure 33:
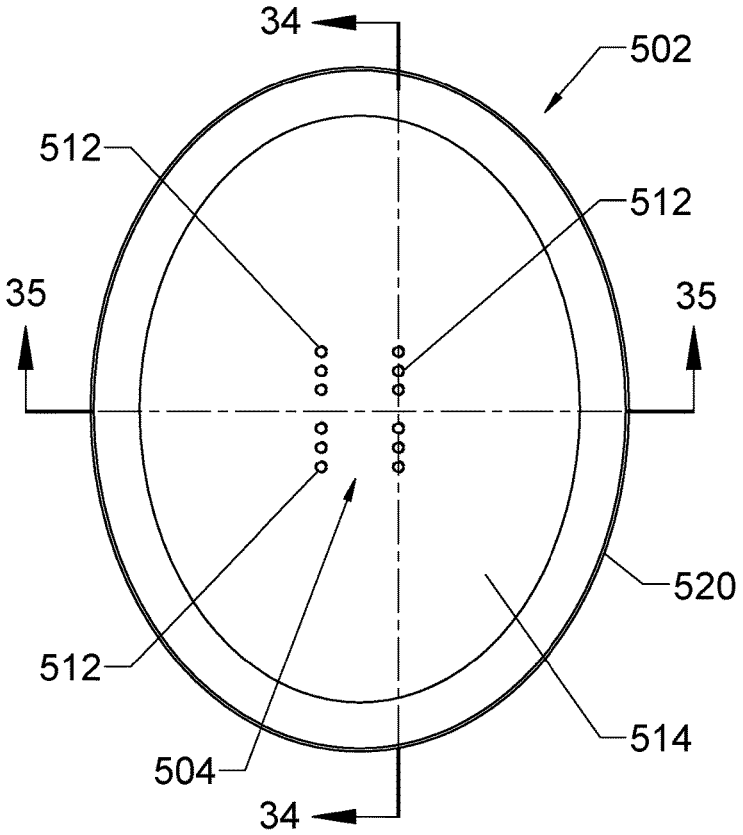
Figure 34:
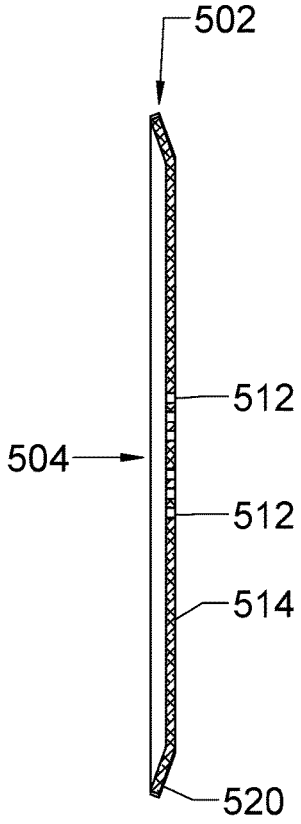
Figure 35:
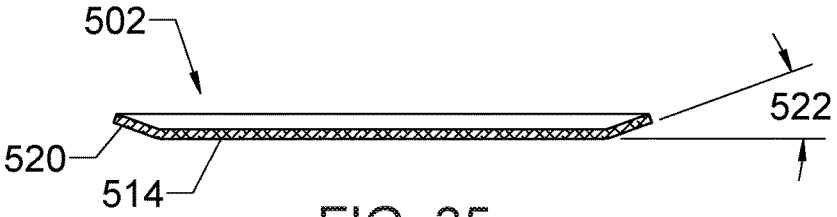

FIG. 5;

FIG. 8 is an isometric view of another exemplary embodiment of a snow ski assembly according to the present disclosure;

FIG. 9 is an exploded isometric view of the snow ski assembly of FIG. 8;

FIG. 10 is a top plan view of the snow ski assembly of FIG. 8;

FIG. 11 is a section view of the snow ski assembly of FIG. 8, taken in a plane including line 11-11 in FIG. 10;

FIG. 12 is a top plan view of a ski of the snow ski assembly of FIG. 8;

FIG. 13 is a section view of the ski of FIG. 12, taken in a plane including line 13-13 in FIG. 12;

FIG. 14 is a section view of the ski of FIG. 12, taken in a plane including line 14-14 in FIG. 12;

FIG. 15 is an isometric view of another exemplary embodiment of a snow ski assembly according to the present disclosure;

FIG. 16 is an exploded isometric view of the snow ski assembly of FIG. 15;

FIG. 17 is a top plan view of the snow ski assembly of FIG. 15;

FIG. 18 is a section view of the snow ski assembly of FIG. 15, taken in a plane including line 18-18 in FIG. 17;

FIG. 19 is a top plan view of a ski of the snow ski assembly of FIG. 15;

FIG. 20 is a section view of the ski of FIG. 19, taken in a plane including line 20-20 in FIG. 19;

FIG. 21 is a section view of the ski of FIG. 19, taken in a plane including line 21-21 in FIG. 19;

FIG. 22 is an isometric view of still another exemplary embodiment of a snow ski assembly according to the present disclosure;

FIG. 23 is an exploded isometric view of the snow ski assembly of FIG. 22;

FIG. 24 is a top plan view of the snow ski assembly of FIG. 22;

FIG. 25 is a section view of the snow ski assembly of FIG. 22, taken in a plane including line 25-25 in FIG. 24;

FIG. 26 is a top plan view of a ski of the snow ski assembly of FIG. 22;

FIG. 27 is a section view of the ski of FIG. 26, taken in a plane including line 27-27 in FIG. 26;

FIG. 28 is a section view of the ski of FIG. 26, taken in a plane including line 28-28 in FIG. 26;

FIG. 29 is an isometric view of another exemplary embodiment of a snow ski assembly according to the present disclosure;

FIG. 30 is an exploded isometric view of the snow ski assembly of FIG. 29;

FIG. 31 is a top plan view of the snow ski assembly of FIG. 29;

FIG. 32 is a section view of the snow ski assembly of FIG. 29, taken in a plane including line 32-32 in FIG. 31;

FIG. 33 is a top plan view of a ski of the snow ski assembly of FIG. 29;

FIG. 34 is a section view of the ski of FIG. 33, taken in a plane including line 34-34 in FIG. 33; and FIG. 35 is a section view of the ski of FIG. 33, taken in a plane including line 35-35 in FIG. 33.

Corresponding reference numerals indicate corresponding parts throughout the several views of the drawings.

DETAILED DESCRIPTION

The present disclosure generally relates to snow ski assemblies (broadly, transport devices) for use by individuals to travel on snow and/or ice (e.g., move, slide, ski, etc. across the snow and/or ice). The snow ski assemblies are configured to be worn by the individuals on their feet, with one snow ski assembly on each foot (such that two of the snow ski assemblies are used by each of the individuals). The individuals can then use the snow ski assemblies, for example, at a ski slope, etc. to travel across and/or down snow and/or ice on the ski slope under the force of gravity.

Exemplary embodiments of the snow ski assemblies include skis (broadly, bodies) for supporting movement of the individuals wearing the snow ski assemblies. As will be described, the skis, and various features thereof (alone or in combination), facilitate movement of the individuals wearing the snow ski assemblies in any direction (without preference for any one particular direction) across the snow and/or ice (e.g., under the force of gravity, etc.).

In some embodiments, the skis of the snow ski assemblies have generally rounded shapes when viewed in plan. For example, the skis may have generally circular shapes, generally elliptical shapes, etc. The generally rounded shapes of the skis may help facilitate movement of the snow ski assemblies in the multiple different directions (e.g., forward, backward, sideways, etc.). In other embodiments, the skis may have shapes other than rounded shapes, for example, generally octagonal shapes, etc. that may also help facilitate movement of the snow ski assemblies in the multiple different directions. In addition, in some aspects the shapes of the skis may be generally symmetrical, while in other aspects they may be generally asymmetrical or may simply include asymmetries as required or needed to accommodate different movement and acrobatic possibilities.

In some embodiments, the skis of the snow ski assemblies also (or alternatively) include bottom surfaces (e.g., surfaces configured to contact the snow and/or ice when the snow ski assemblies are moving, etc.) with geometries, shapes, etc. that are generally flat (or planar). In these embodiments, the bottom surfaces themselves may be substantially flat, or the bottom surfaces may include portions that are generally flat. In other embodiments, the skis of the snow ski assemblies include bottom surfaces with geometries, shapes, etc. that are generally rounded (or at least partially rounded) (e.g., that have generally rounded cross sections, etc.). In these embodiments, for example, the generally rounded bottom surfaces of the snow ski assemblies may have geometries, shapes, etc. that are generally circular, generally near circular, generally elliptical, generally parabolic, generally hyperbolic, etc. It should be appreciated that the various different available geometries, shapes, etc. of the bottom surfaces of the skis of the different embodiments of snow ski assemblies may help accommodate different movements and acrobatic stunts by individuals using the snow ski assemblies. It should also be appreciated that sizes of the bottom surfaces of the skis may vary, for example, to accommodate different movements and acrobatic possibilities by individuals using the skis and/or different sizes of individuals desiring to use the skis.

In some embodiments, the skis of the snow ski assemblies also (or alternatively) include perimeter portions or peripheral regions, extending around the skis, that are upturned (e.g., that transition (e.g., via variable curvature, etc.) from the bottom surfaces, etc.). The upturned portions/regions, for example, may help inhibit, reduce, minimize, etc. interference of the snow and/or ice with movement of the skis and may help accommodate different movement and acrobatic possibilities. In addition, in embodiments where the upturned portions/regions extend substantially around the skis, the upturned portions/regions may further help facilitate movement of the snow ski assemblies in the multiple different directions (without preference for any one particular direction). Here, the skis can be viewed as being free of edges typically used in traditional skis to control and/or stop the skis. However, in some embodiments, the upturned portions/regions may be used, to various extents, to help control and/or stop the skis. In some aspects, the upturned portions/regions of the skis may be generally flat (e.g., may have portions that are generally flat or generally linear, etc.). In other aspects, the upturned edges of the skis may have geometries, shapes, etc. that are generally rounded or curved (e.g., generally elliptical, generally hyperbolic, etc.). In addition, it should also be appreciated that sizes (e.g., lengths, etc.) of the upturned portions/regions of the skis may vary, for example, to accommodate different movements and acrobatic possibilities by individuals using the skis.

Exemplary embodiments of the snow ski assemblies also include mounting features for use in coupling bindings to the skis of the snow ski assemblies. The bindings are configured to secure boots to the skis, such that the individuals using the snow ski assemblies can wear the boots on their feet with the skis coupled thereto (via the bindings). In some aspects, the mounting features of the snow ski assemblies may be integral (or monolithic) with the skis (e.g., the mounting features may be integrally formed with upper surfaces of the skis, may be defined by portions of the skis, etc.). In other aspects, the mounting features may be separate components from the skis and configured to couple to the skis (e.g., to the upper surfaces of the skis, etc.).

Exemplary embodiments of the snow ski assemblies will now be described more fully with reference to the accompanying drawings.

FIGS. 1-7 illustrate an exemplary embodiment of a snow ski assembly 100 (again broadly, a transport device) according to the present disclosure. The snow ski assembly 100 is configured to be worn by an individual on one of the individual's feet, with a second snow ski assembly (e.g., a second snow ski assembly that is the same as snow ski assembly 100, snow ski assembly 200, snow ski assembly 300, snow ski assembly 400, snow ski assembly 500, etc.) then configured to be worn by the individual on the other one of the individual's feet. As such, the individual uses two of the snow ski assemblies to travel (e.g., move, slide, etc.) across snow and/or ice as desired, for example, at a ski slope under the force of gravity, etc. Uniquely, the snow ski assembly 100 allows the individual to move in any direction across the snow and/or ice without preference for any one particular direction.

As shown in FIGS. 1-4, the snow ski assembly 100 generally includes a ski 102 (broadly, a body), a mounting feature 104 (e.g., a mount, a mounting structure, a mounting portion, etc.), and a binding 106. The binding 106 couples to the ski 102 at the mounting feature 104 and is configured to secure a boot 108 to the ski 102 so that the individual can wear the ski 102, via the boot 108 and binding 106, on one of the individual's feet. The illustrated binding 106 includes straps 110 that secure over, around, etc. the boot 108 to hold the boot 108 (and the individual's foot inside the boot 108) in the binding 106 (and, thus, the ski 102 on the individual's foot). However, other means may be used with the binding 106 for securing the boot 108 in the binding 106 (e.g., friction fittings, clips, other mechanical fasteners, etc.). In addition, it should be appreciated that any suitable binding can be used with the snow ski assembly 100 within the scope of the present disclosure.

The mounting feature 104 of the snow ski assembly 100 includes multiple openings 112 defined in a bottom wall 114 of the ski 102. Fasteners 116 (e.g., screws, etc.) are configured to extend through openings in a lower portion of the binding 106, and into the corresponding openings 112, to couple the binding 106 to the mounting feature 104 (and to the ski 102). The position of the binding 106 on the ski 102 can be adjusted, as desired, by moving the fasteners 116 to different ones, or instances, of the openings 112 (which results in a different positioning of the binding 106 on the ski 102). In the illustrated embodiment, the mounting feature 104 includes twelve openings 112, arranged in four groups of three. And four fasteners 116 are used to couple the binding 106 to the mounting feature 104 (with one of the four fasteners 116 positioned in one of the openings 112 of each group, depending on desired positioning of the binding 106 on the ski 102). It should be appreciated that the mounting feature 104 may include a different number and/or arrangement of openings 112, and/or a different number of fasteners 116 may be used to couple the binding 106 to the mounting feature 104, for example, to accommodate different bindings, etc. In addition, in other exemplary embodiments, snow ski assemblies may include mounting features with structure other than openings (e.g., clips, straps, etc.) for use in coupling bindings to skis.

In the illustrated embodiment, the mounting feature 104 is integrally defined by (e.g., monolithically formed with, etc.) the ski 102 of the snow ski assembly 100. In other exemplary embodiments, snow ski assemblies may include mounting features separate from skis and attached thereto (see, for example, the snow ski assembly 200 illustrated in FIGS. 8-14, etc.).

With continued reference to FIGS. 1-4, the ski 102 of the snow ski assembly 100 is sized to receive the boot 108 generally within a footprint of the ski 102. In particular, the illustrated ski has a diameter dimension of about sixteen inches for receiving the correspondingly sized boot 108. However, the ski 102 may be sized differently as desired (e.g., the ski 102 may have a diameter dimension greater than or less than about sixteen inches, etc.), for example, to permit production of the ski 102 in a manner to accommodate different users having different foot sizes and, thus, different sizes of boots (e.g., ranging from youth to adult, etc.), as well as to accommodate different movements and acrobatic possibilities, etc. For example, in various embodiments, snow ski assemblies may include skis with diameters ranging anywhere from about four inches to about thirty-six inches or more, etc.

Figure 1:
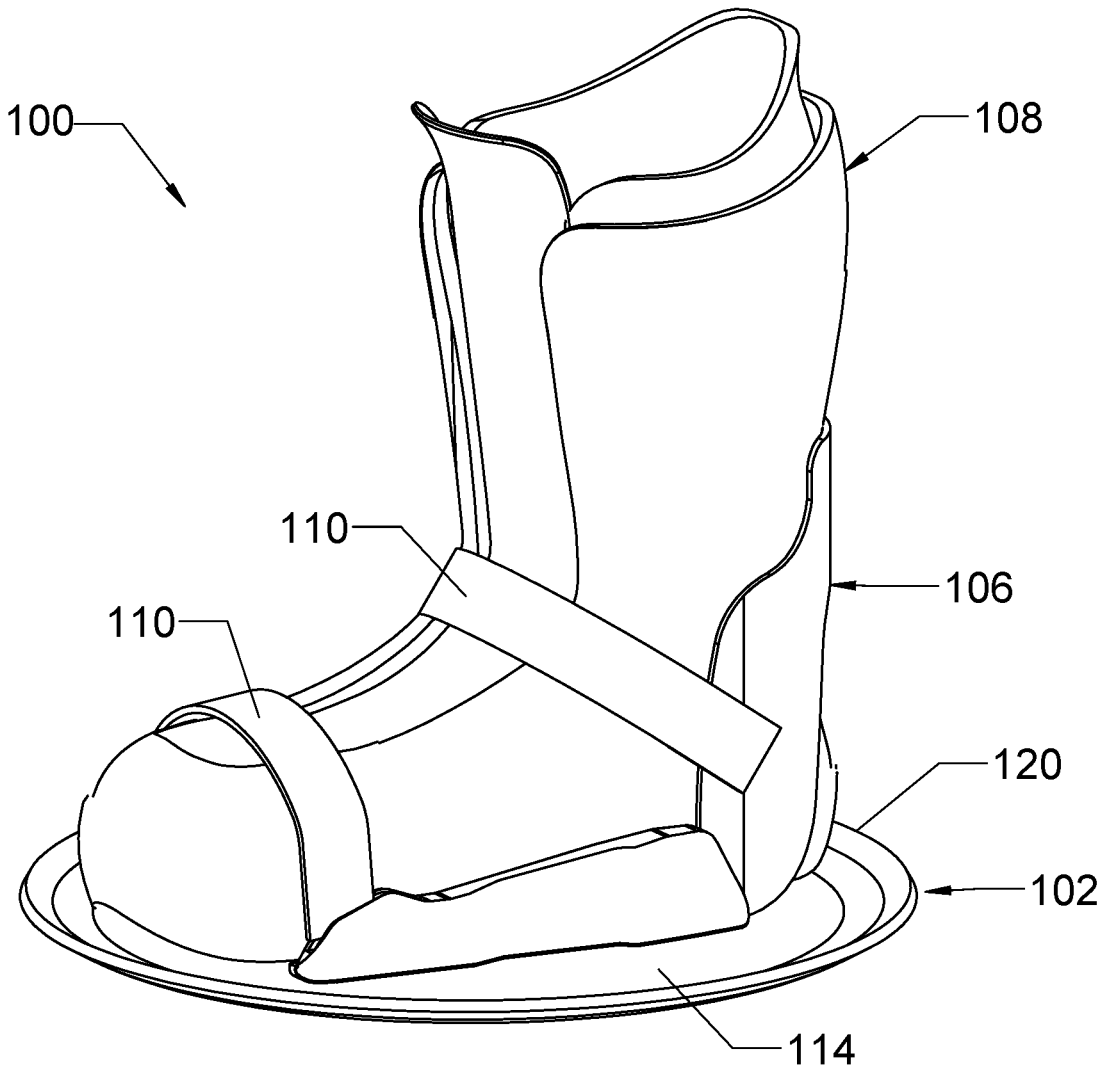
FIG. 1 is an isometric view of an exemplary embodiment of a snow ski assembly according to the present disclosure.
Figure 2:
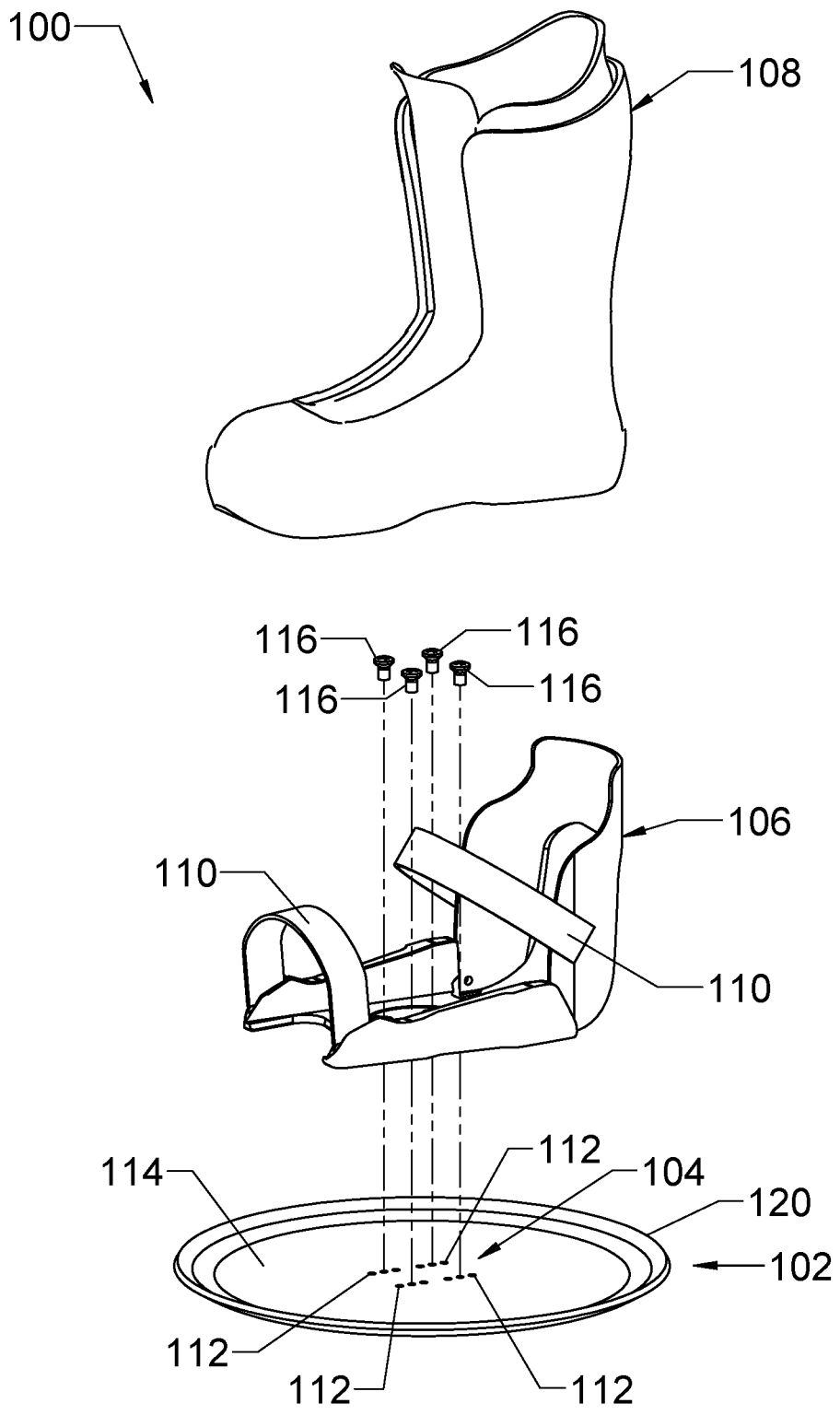
FIG. 2 is an exploded isometric view of the snow ski assembly of FIG. 1.
Figure 3:
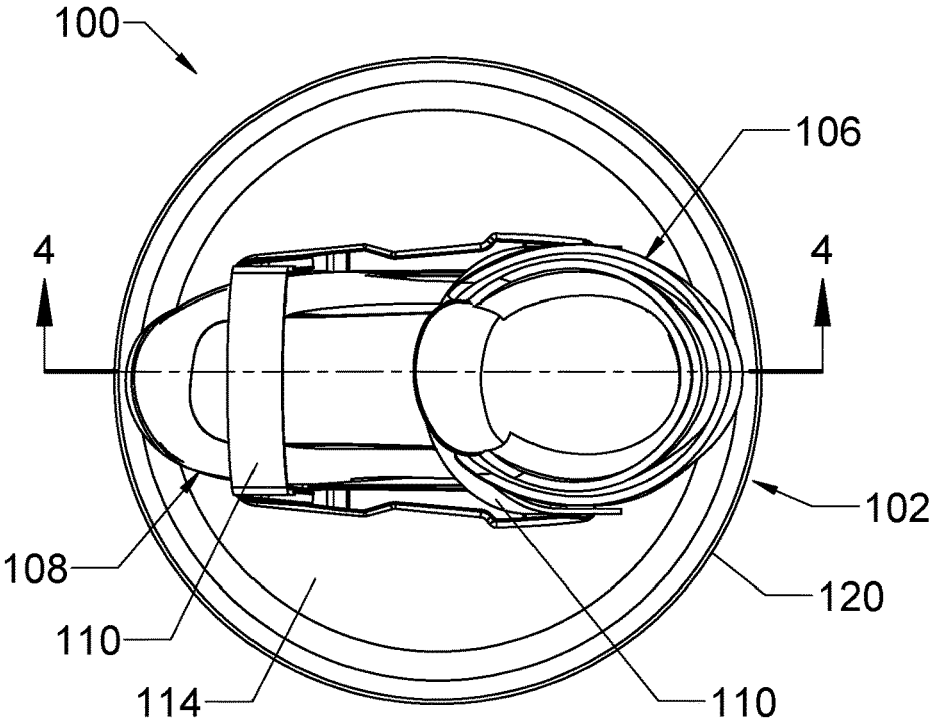
FIG. 3 is a top plan view of the snow ski assembly of FIG. 1.
Figure 4:
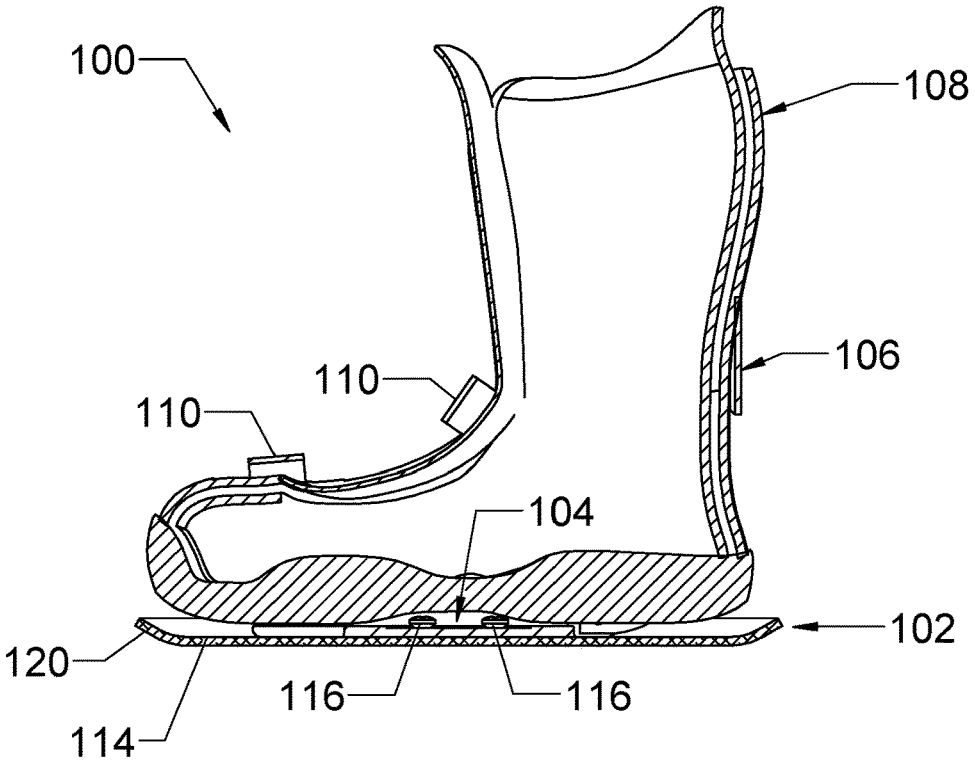
FIG. 4 is a section view of the snow ski assembly of FIG. 1, taken in a plane including line 4-4 in FIG. 3.
Figure 5:
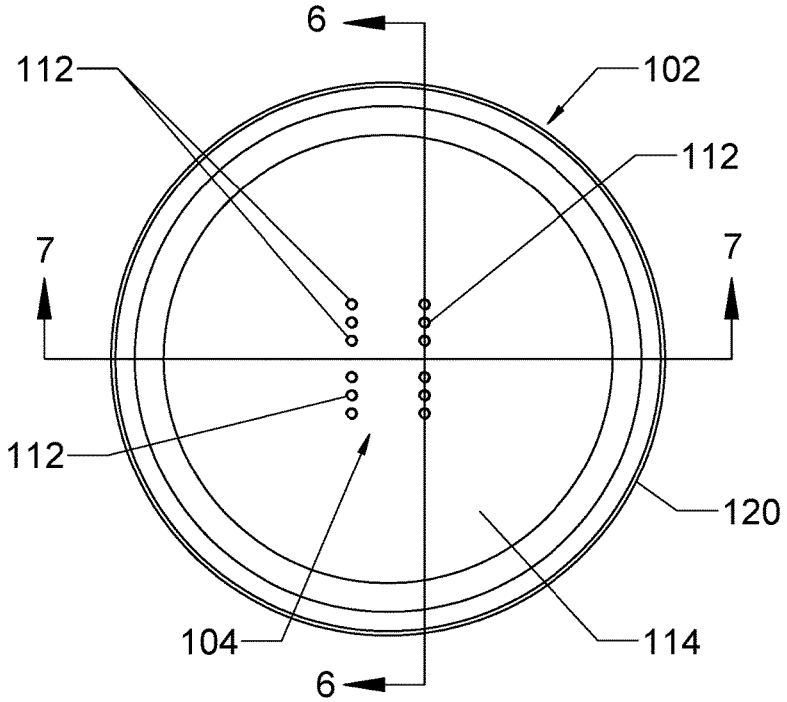
FIG. 5 is a top plan view of a ski of the snow ski assembly of FIG. 1.
Figure 6:
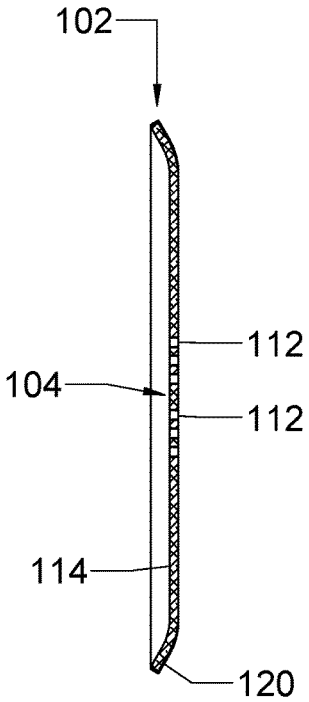
FIG. 6 is a section view of the ski of FIG. 5, taken in a plane including line 6-6 in FIG. 5.
Figure 7:
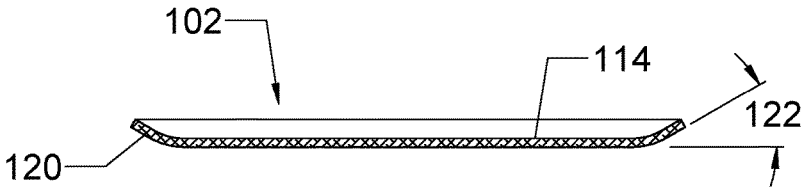

With additional reference now to FIGS. 5-7, the ski 102 of the snow ski assembly 100 generally includes the bottom wall 114 having an upturned peripheral region 120 (e.g., an upturned lip portion, an upturned peripheral portion located toward a perimeter of the bottom wall 114, an upturned sidewall, etc.). The upturned peripheral region 120 of the ski 102 generally extends around a peripheral portion (or perimeter portion) of the bottom wall 114 (e.g., the upturned peripheral region 120 extends generally continuously around the bottom wall 114 of the ski 102, etc.) and is generally free of protrusions and obstructions. And together, the bottom wall 114 and the upturned peripheral region 120 provide the ski 102 with a generally circular (or disk) shape or footprint (when viewed in plan). In the illustrated embodiment, the bottom wall 114 and the upturned peripheral region 120 thereof are integrally formed. However, in other embodiments, the peripheral region 120 may be separate from the bottom wall 114 and attached thereto (e.g., welded thereto, etc.). In addition, in other exemplary embodiments, snow ski assemblies may include skis with bottom walls and peripheral regions defining other shapes or footprints (e.g., elliptical shapes, etc.) when the skis are viewed in plan. Further, it should be appreciated that a size (e.g., a length, etc.) of the upturned peripheral region 120 may vary, for example, to accommodate different movements and acrobatic possibilities by individuals using the ski.

The bottom wall 114 of the ski 102 (e.g., a central region of the ski 102, etc.) is generally flat (or planar) across a width (e.g., along a diameter dimension, etc.) of the ski 102, and is generally radially symmetric. And, the upturned peripheral region 120 of the ski 102 is generally flat (or generally linear) along a length of the peripheral region 120 from the flat bottom wall 114 to a perimeter edge of the ski 102. In the illustrated embodiment, the upturned peripheral region 120 forms an angle 122 with the flat bottom wall 114 of about thirty degrees (generally consistently around the perimeter of the ski 102). However, the angle 122 may be greater than or less than about thirty degrees, as desired (e.g., depending on desired movement of the ski 102 across snow and/or ice, etc.) (e.g., the angle 122 may include an angle greater than zero degrees, etc.). In addition, in other exemplary embodiments, snow ski assemblies may include skis with bottom walls and/or peripheral regions having geometries, shapes, etc. that are other than generally flat and/or that are asymmetric and/or that include asymmetries (e.g., to help accommodate different movements and/or acrobatic possibilities using the snow ski assemblies, etc.). For example, in such embodiments, the bottom walls and/or the peripheral regions of the skis may include geometries, shapes, etc. that are generally rounded (e.g., generally circular shapes, generally near circular shapes, generally elliptical shapes, generally parabolic shapes, generally hyperbolic shapes, etc.), etc.

In use of the snow ski assembly 100 (i.e., when the snow ski assembly 100 is worn by the individual on one of the individual's feet), the bottom wall 114 (e.g., a bottom surface of the bottom wall 114, etc.) engages the snow and/or ice during movement of the snow ski assembly 100. And, the upturned peripheral region 120 allows the ski 102 to move over the snow and/or ice without interference from the snow and/or ice (e.g., as compared to traditional rectangular-shaped skis that have edges on their long sides that are configured to dig into the snow and/or ice, etc.). Further, the shape of the ski 102 (as described above) and the positioning of the upturned peripheral region 120 around the entire peripheral portion of the bottom wall 114 allows movement of the ski 102 in any direction without such interference from the snow and/or ice (e.g., without the snow and/or ice engaging a side cut or other formed edge of the ski 102 as in traditional snow skis, without the ski 102 digging or biting into the snow and/or ice as in traditional snow skis, etc.). However, it should be appreciated that this does not infer that a user of the snow ski assembly 100 could not, by means of manipulation of his or her body, rotate (e.g., tip, tilt, etc.) the ski assembly 100 such that the upturned peripheral region 120 could be used for control if desired.

As described above, the snow ski assembly 100 is configured to be used in combination with a second snow ski assembly by an individual, such that one snow ski assembly is worn on each foot by the individual. The two snow ski assemblies used by the individual may be the same, for example, both may be the snow ski assembly 100 illustrated in FIGS. 1-7. Alternatively, two different snow ski assemblies may be used. For example, one may be the snow ski assembly 100 illustrated in FIGS. 1-7, and the other may be any one of the other snow ski assemblies described herein (e.g., snow ski assembly 200, etc.), or any other suitable snow ski assembly.

FIGS. 8-14 illustrate another exemplary embodiment of a snow ski assembly 200 according to the present disclosure. The snow ski assembly 200 of this embodiment is similar to the snow ski assembly 100 previously described and illustrated in FIGS. 1-7. For example, the snow ski assembly 200 of this embodiment is again configured to be worn by an individual on one of the individual's feet, with a second snow ski assembly 200 (e.g., another snow ski assembly 200, etc.) then configured to be worn by the individual on the individual's other foot. As such, the individual again uses two of the snow ski assemblies to travel (e.g., move, slide, etc.) across snow and/or ice as desired, for example, at a ski slope under the force of gravity, etc. Uniquely, the snow ski assembly 200 allows the individual to move in any direction across the snow and/or ice without preference for any one particular direction.

As shown in FIGS. 8-11, the snow ski assembly 200 of this embodiment generally includes a ski 202, a spacer 230, a mounting feature 204, and a binding 206. The spacer 230 couples to the ski 202 within an interior region 232 defined by the ski 202. Fasteners 234 (e.g., screws, etc.) are configured to extend through openings 236 of the spacer 230, and into corresponding openings 238 in a lower portion of the ski 202, to thereby couple the spacer 230 to the ski 202. And, the binding 206 couples to the ski 202 at the mounting feature 204, via the spacer 230, and is configured to secure a boot 208 to the ski 202 so that the individual can wear the ski 202, via the boot 208 and binding 206, on one of the individual's feet. Straps 210 of the binding 206 then help hold the boot 208 in the binding 206. As can be seen, the spacer 230 provides a generally flat surface on which to mount the boot 208, and is configured to elevate the binding 206 generally above the ski 202 so that the boot 208 can be received in the binding 206 without interference from the ski 202. With that said, it should again be appreciated that any suitable binding can be used with the snow ski assembly 200.

The mounting feature 204 of the snow ski assembly 200 includes multiple openings 212 defined in an upper surface of the spacer 230. Fasteners 216 are configured to extend through openings in a lower portion of the binding 206, and into the corresponding openings 212, to couple the binding 206 to the mounting feature 204 (and to the spacer 230 and ski 202). The position of the binding 206 on the ski 202 (and on the spacer 230) can be adjusted, as desired, by moving the fasteners 216 to different ones, or instances, of the openings 212 (which results in a different positioning of the binding 206 on the ski 202). In the illustrated embodiment, the mounting feature 204 includes twelve openings 212, arranged in four groups of three. And four fasteners 216 are used to couple the binding 206 to the mounting feature 204 (with one of the four fasteners 216 positioned in one of the openings 212 of each group, depending on desired positioning of the binding 206 on the ski 202). It should be appreciated that the mounting feature 204 may include a different number and/or arrangement of openings 212, and/or a different number of fasteners 216 may be used to couple the binding 206 to the mounting feature 204, for example, to accommodate different bindings, etc. In addition, in other exemplary embodiments, snow ski assemblies may include mounting features with structure other than openings (e.g., clips, straps, etc.) for use in coupling bindings to skis.

In this embodiment, the mounting feature 204 of the snow ski assembly 200 is separate from the ski 202. The mounting feature 204 is integrally defined by (e.g., monolithically formed with, etc.) the spacer 230 of the snow ski assembly 200 and then coupled, via the spacer 230, to the ski 202. In other exemplary embodiments, snow ski assemblies may include mounting features separate from spacers and coupled thereto. In addition, in other exemplary embodiments, snow ski assemblies may include spacers (and, in some embodiments, mounting features) integrally defined by (e.g., monolithically formed with, etc.) skis.

With continued reference to FIGS. 8-11, the ski 202 and spacer 230 of the snow ski assembly 200 are sized to receive the boot 208 generally within a footprint of the ski 202. In particular, the illustrated ski 202 has a major diameter dimension of about sixteen inches for receiving the correspondingly sized spacer 230 in the interior region 232 of the ski 202, and the correspondingly sized boot 208 thereon. In addition, the spacer 230 is sized such that the upper surface of the spacer 230 is positioned generally below an upper edge of the ski 202 by a distance 224 (FIG. 14) (e.g., about 0.25 inches, about 0.5 inches, about 1 inch, distances therebetween, other distances such as distances greater than about 1 inch or less than about 0.25 inches, etc.). However, the ski 202 and/or the spacer 230 may be sized differently as desired (e.g., the ski 202 may have a diameter dimension greater than or less than about sixteen inches, etc.), for example, to permit production of the ski 202 in a manner to accommodate different users having different foot sizes and, thus, different sizes of boots (e.g., ranging from youth to adult, etc.), as well as to accommodate different movements and acrobatic possibilities, etc. For example, in various embodiments, snow ski assemblies may include skis with diameters ranging anywhere from about four inches to about thirty-six inches or more, etc., and spacers configured to fit within interior regions of the skis.

With additional reference now to FIGS. 12-14, the ski 202 of the snow ski assembly 200 generally includes a bottom wall 214 having an upturned peripheral region 220 (e.g., an upturned lip, an upturned peripheral edge located toward a perimeter of the bottom wall 214, etc.). The upturned peripheral region 220 of the ski 202 generally extends around a peripheral portion (or perimeter portion) of the bottom wall 214 (e.g., the upturned peripheral region 220 extends generally continuously around the bottom wall 214 of the ski 202, etc.) and is generally free of protrusions and obstructions. And together, the bottom wall 214 and the upturned peripheral region 220 provide the ski 202 with a generally circular (or disk) shape or footprint (when viewed in plan). In other exemplary embodiments, snow ski assemblies may include skis with bottom walls and peripheral regions defining other shapes or footprints (e.g., elliptical shapes, etc.) when the skis are viewed in plan. Further, it should be appreciated that a size (e.g., a length, etc.) of the upturned peripheral region 220 may vary, for example, to accommodate different movements and acrobatic possibilities by individuals using the ski 202.

The bottom wall 214 of the ski 202 (e.g., a central region of the ski 202, etc.) is generally rounded from the peripheral region 220 on one side of the ski 202 to the peripheral region 220 on the other side of the ski (e.g., defines a generally rounded cross section as shown in FIGS. 11, 13, 14; etc.), and is generally radially symmetric. In the illustrated embodiment, the rounded bottom wall 214 of the ski 202 is generally circular (or arc) shaped and extends/transitions smoothly to the upturned peripheral region 220 generally consistently around the perimeter of the ski 202 (such that, in this embodiment, the upturned peripheral region 220 is an extension of the bottom wall 214 and generally coincides with the bottom wall 214). However, the rounded bottom wall 214 may have other shapes, for example, generally near circular shapes, generally elliptical shapes, generally parabolic shapes, generally hyperbolic shapes, etc. and/or other geometries (e.g., asymmetric geometries, generally symmetric geometries that include asymmetries to help accommodate different movements and acrobatic possibilities, etc.) within the scope of the present disclosure (e.g., to help accommodate different movements and/or acrobatic possibilities using the snow ski assemblies, etc.).

In use of the snow ski assembly 200 (i.e., when the snow ski assembly 200 is worn by the individual on one of the individual's feet), the bottom wall 214 (e.g., a bottom surface of the bottom wall 214, etc.) engages the snow and/or ice during movement of the snow ski assembly 200. And, the upturned peripheral region 220 allows the ski 202 to move without interference from the snow and/or ice (e.g., without digging or biting into the snow and/or ice, etc.). Further, the shape of the ski 202 (as described above) and the positioning of the upturned peripheral region 220 around the entire periphery of the bottom wall 214 allows movement of the ski 202 in any direction, again without such interference from the snow and/or ice (e.g., without the ski 202 digging or biting into the snow and/or ice). However, it should again be appreciated that this does not infer that a user of the snow ski assembly 200 could not, by means of manipulation of his or her body, rotate (e.g., tip, tilt, etc.) the ski assembly 200 such that the upturned peripheral region 220 could be used for control if desired.

FIGS. 15-21 illustrate another exemplary embodiment of a snow ski assembly 300 according to the present disclosure. The snow ski assembly 300 of this embodiment is similar to the snow ski assembly 200 previously described and illustrated in FIGS. 8-14. For example, the snow ski assembly 300 of this embodiment is again configured to be worn by an individual on one of the individual's feet, with a second snow ski assembly (e.g., another one of snow ski assembly 300, etc.) then configured to be worn by the individual on the individual's other foot. As such, the individual again uses two of the snow ski assemblies to travel (e.g., move, slide, etc.) across snow and/or ice as desired, for example, at a ski slope under the force of gravity, etc. Uniquely, the snow ski assembly 300 allows the individual to move in any direction across the snow and/or ice without preference for any one particular direction.

As shown in FIGS. 15-18, the snow ski assembly 300 of this embodiment generally includes a ski 302, a spacer 330, a mounting feature 304, and a binding 306. The spacer 330 couples to the ski 302 within an interior region 332 defined by the ski 302. Fasteners 334 (e.g., screws, etc.) are configured to extend through openings 336 of the spacer 330, and into corresponding openings 338 in a lower portion of the ski 302, to thereby couple the spacer 330 to the ski 302. And, the binding 306 couples to the ski 302 at the mounting feature 304, via the spacer 330, and is configured to secure a boot 308 to the ski 302 so that the individual can wear the ski 302, via the boot 308 and binding 306, on one of the individual's feet. Straps 310 of the binding 306 then help hold the boot 308 in the binding 306. As can be seen, the spacer 330 provides a generally flat surface on which to mount the boot 308, and is configured to elevate the binding 306 generally above the ski 302 so that the boot 308 can be received in the binding 306 without interference from the ski 302. With that said, it should again be appreciated that any suitable binding can be used with the snow ski assembly 300.

The mounting feature 304 of the snow ski assembly 300 includes multiple openings 312 defined in an upper surface of the spacer 330. Fasteners 316 are configured to extend through openings in a lower portion of the binding 306, and into the corresponding openings 312, to couple the binding 306 to the mounting feature 304 (and to the spacer 330 and ski 302). The position of the binding 306 on the ski 302 (and on the spacer 330) can be adjusted, as desired, by moving the fasteners 316 to different ones, or instances, of the openings 312 (which results in a different positioning of the binding 306 on the ski 302). In the illustrated embodiment, the mounting feature 304 includes twelve openings 312, arranged in four groups of three. And four fasteners 316 are used to couple the binding 306 to the mounting feature 304 (with one of the four fasteners 316 positioned in one of the openings 312 of each group, depending on desired positioning of the binding 306 on the ski 302). It should be appreciated that the mounting feature 304 may include a different number and/or arrangement of openings 312, and/or a different number of fasteners 316 may be used to couple the binding 306 to the mounting feature 304, for example, to accommodate different bindings, etc. In addition, in other exemplary embodiments, snow ski assemblies may include mounting features with structure other than openings (e.g., clips, straps, etc.) for use in coupling bindings to skis.

In this embodiment, the mounting feature 304 of the snow ski assembly 300 is again separate from the ski 302. The mounting feature 304 is integrally defined by (e.g., monolithically formed with, etc.) the spacer 330 of the snow ski assembly 300 and then coupled, via the spacer 330, to the ski 302. In other exemplary embodiments, snow ski assemblies may include mounting features separate from spacers and coupled thereto. In addition, in other exemplary embodiments, snow ski assemblies may include spacers (and, in some embodiments, mounting features) integrally defined by (e.g., monolithically formed with, etc.) skis.

With continued reference to FIGS. 15-18, the ski 302 and spacer 330 of the snow ski assembly 300 are sized to receive the boot 308 generally within a footprint of the ski 302. In addition in this embodiment, the spacer 330 is sized such that the upper surface of the spacer 330 is positioned generally below an upper edge of the ski 302 by a distance 324 (FIG. 21) and the boot 308 is received on the spacer 330 partially within the interior region 332 of the ski 302. The illustrated ski 302 has a diameter dimension of about sixteen inches for receiving the correspondingly sized spacer 330 in the interior region 332 of the ski 302, and the correspondingly sized boot 308 thereon. However, the ski 302 and/or the spacer 330 may be sized differently as desired (e.g., the ski 302 may have a diameter dimension greater than or less than about sixteen inches, etc.), for example, to permit production of the ski 302 in a manner to accommodate different users having different foot sizes and, thus, different sizes of boots (e.g., ranging from youth to adult, etc.), as well as to accommodate different movements and acrobatic possibilities, etc. For example, in various embodiments, snow ski assemblies may include skis with diameters ranging anywhere from about four inches to about thirty-six inches, and spacers configured to fit within interior regions of the skis.

With additional reference now to FIGS. 19-21, the ski 302 of the snow ski assembly 300 generally includes a bottom wall 314 having an upturned peripheral region 320 (e.g., an upturned lip portion, an upturned peripheral portion located toward a perimeter of the bottom wall 314, etc.). The upturned peripheral region 320 of the ski 302 generally extends around a peripheral portion (or perimeter portion) of the bottom wall 314 (e.g., the upturned peripheral region 320 extends generally continuously around the bottom wall 314 of the ski 302, etc.) and is generally free of protrusions and obstructions. And together, the bottom wall 314 and the upturned peripheral region 320 provide the ski 302 with a generally circular (or disk) shape or footprint (when viewed in plan). In other exemplary embodiments, snow ski assemblies may include skis with bottom walls and peripheral regions defining other shapes or footprints (e.g., elliptical shapes, etc.) when the skis are viewed in plan. Further, it should be appreciated that a size (e.g., a length, etc.) of the upturned peripheral region 320 may vary, for example, to accommodate different movements and acrobatic possibilities by individuals using the ski 302.

The bottom wall 314 of the ski 302 (e.g., a central region of the ski 302, etc.) is also generally rounded from the peripheral region 320 on one side of the ski 302 to the peripheral region 320 on the other side of the ski 302 (as viewed in FIGS. 20 and 21), and is generally radially symmetric. In the illustrated embodiment, the rounded bottom wall 314 of the ski 302 is generally circular (or arc) shaped and extends/transitions smoothly to the upturned (and generally rounded) peripheral region 320 generally consistently around the perimeter of the ski 302 (such that, in this embodiment, the upturned peripheral region 320 is a generally symmetric extension of the bottom wall 314 and generally coincides with the bottom wall 314). However, the rounded bottom wall 314 may have other shapes, for example, generally near circular shapes, generally elliptical shapes, generally parabolic shapes, generally hyperbolic shapes, etc. and/or other geometries (e.g., asymmetric geometries, generally symmetric geometries that include asymmetries to help accommodate different movements and acrobatic possibilities, etc.) within the scope of the present disclosure (e.g., to help accommodate different movements and/or acrobatic possibilities using the snow ski assembly 300, etc.).

In use of the snow ski assembly 300 (i.e., when the snow ski assembly 300 is worn by the individual on one of the individual's feet), the bottom wall 314 (e.g., a bottom surface of the bottom wall 314, etc.) again engages the snow and/or ice during movement of the snow ski assembly 300. And, the upturned peripheral region 320 allows the ski 302 to move without interference from the snow and/or ice (e.g., without digging or biting into the snow and/or ice, etc.). Further, the shape of the ski 302 (as described above) and the positioning of the upturned peripheral region 320 around the entire periphery of the bottom wall 314 allows movement of the ski 302 in any direction, again without such interference from the snow and/or ice (e.g., without the peripheral region 320 of the ski 302 digging or biting into the snow and/or ice). However, it should again be appreciated that this does not infer that a user of the snow ski assembly 300 could not, by means of manipulation of his or her body, rotate (e.g., tip, tilt, etc.) the ski assembly 300 such that the upturned peripheral region 320 could be used for control if desired.

FIGS. 22-28 illustrate another exemplary embodiment of a snow ski assembly 400 according to the present disclosure. The snow ski assembly 400 of this embodiment is again similar to the snow ski assembly 200 previously described and illustrated in FIGS. 8-14. For example, the snow ski assembly 400 of this embodiment is configured to be worn by an individual on one of the individual's feet, with a second snow ski assembly (e.g., another one of snow ski assembly 400, etc.) then configured to be worn by the individual on the individual's other foot. As such, the individual again uses two of the snow ski assemblies to travel (e.g., move, slide, etc.) across snow and/or ice as desired, for example, at a ski slope under the force of gravity, etc. Uniquely, the snow ski assembly 400 allows the individual to move in any direction across the snow and/or ice without preference for any one particular direction.

As shown in FIGS. 22-25, the snow ski assembly 400 of this embodiment generally includes a ski 402, a spacer 430, a mounting feature 404, and a binding 406. The spacer 430 couples to the ski 402 within an interior region 432 defined by the ski 402. Fasteners 434 (e.g., screws, etc.) are configured to extend through openings 436 of the spacer 430, and into corresponding openings 438 in a lower portion of the ski 402, to thereby couple the spacer 430 to the ski 402. And, the binding 406 couples to the ski 402 at the mounting feature 404, via the spacer 430, and is configured to secure a boot 408 to the ski 402 so that the individual can wear the ski 402, via the boot 408 and binding 406, on one of the individual's feet. Straps 410 of the binding 406 then help hold the boot 408 in the binding 406. As can be seen, the spacer 430 provides a generally flat surface on which to mount the boot 408, and is configured to elevate the binding 406 generally above the ski 402 so that the boot 408 can be received in the binding 406 without interference from the ski 402. With that said, it should again be appreciated that any suitable binding can be used with the snow ski assembly 400.

The mounting feature 404 of the snow ski assembly 400 includes multiple openings 412 defined in an upper surface of the spacer 430. Fasteners 416 are configured to extend through openings in a lower portion of the binding 406, and into the corresponding openings 412, to couple the binding 406 to the mounting feature 404 (and to the spacer 430 and ski). The position of the binding 406 on the ski 402 (and on the spacer 430) can be adjusted, as desired, by moving the fasteners 416 to different ones, or instances, of the openings 412 (which results in a different positioning of the binding 406 on the ski 402). In the illustrated embodiment, the mounting feature 404 includes twelve openings 412, arranged in four groups of three. And four fasteners 416 are used to couple the binding 406 to the mounting feature 404 (with one of the four fasteners 416 positioned in one of the openings 412 of each group, depending on desired positioning of the binding 406 on the ski 402). It should be appreciated that the mounting feature 404 may include a different number and/or arrangement of openings 412, and/or a different number of fasteners 416 may be used to couple the binding 406 to the mounting feature 404, for example, to accommodate different bindings, etc. In addition, in other exemplary embodiments, snow ski assemblies may include mounting features with structure other than openings (e.g., clips, straps, etc.) for use in coupling bindings to skis.

In this embodiment, the mounting feature 404 of the snow ski assembly 400 is again separate from the ski 402. The mounting feature 404 is integrally defined by (e.g., monolithically formed with, etc.) the spacer 430 of the snow ski assembly 400 and then coupled, via the spacer 430, to the ski 402. And again, in other exemplary embodiments, snow ski assemblies may include mounting features separate from spacers and coupled thereto. In addition, in other exemplary embodiments, snow ski assemblies may include spacers (and, in some embodiments, mounting features) integrally defined by (e.g., monolithically formed with, etc.) skis.

With continued reference to FIGS. 22-25, the ski 402 and spacer 430 of the snow ski assembly 400 are sized such that the boot 408 extends generally beyond a footprint of the ski 402 (e.g., generally beyond an upturned peripheral region 420 of the ski 402, etc.). In addition in this embodiment, the spacer 430 is sized such that the upper surface of the spacer 430 is positioned generally above an upper edge of the ski 402 by a distance 424 (FIG. 28) (e.g., about 0.25 inches, about 0.5 inches, about 1 inch, distances therebetween, other distances such as distances greater than about 1 inch or less than about 0.25 inches, etc.) so that the boot 408 is received on the spacer 430 generally above the ski 402 (e.g., generally above the upper edge of the ski 402, etc.). With that said, the illustrated ski 402 has a diameter dimension of about eight inches and is capable of receiving the correspondingly sized spacer 430 in the interior region 432 of the ski 402 (with the spacer 430 extending partially above the upturned peripheral region 420 of the ski 402), and with the correspondingly sized boot 408 then received on the spacer 430. However, the ski 402 and/or the spacer 430 may be sized differently as desired (e.g., the ski 402 may have a diameter dimension greater than or less than about eight inches, etc.), for example, to permit production of the ski 402 in a manner to accommodate different users having different foot sizes and, thus, different sizes of boots (e.g., ranging from youth to adult, etc.), as well as to accommodate different movements and acrobatic possibilities, etc. For example, in various embodiments, snow ski assemblies may include skis with diameters ranging anywhere from about four inches to about thirty-six inches, and spacers configured to fit within interior regions of the skis. It should be appreciated that the smaller size of the illustrated ski 402, as compared to the skis previously described and illustrated, may help facilitate different movements and acrobatic possibilities by individuals wearing the ski 402.

With additional reference now to FIGS. 26-28, the ski 402 of the snow ski assembly 400 generally includes a bottom wall 414 having the upturned peripheral region 420 (e.g., an upturned lip portion, an upturned peripheral portion located toward a perimeter of the bottom wall 414, etc.). The upturned peripheral region 420 of the ski 402 generally extends around a peripheral portion (or perimeter portion) of the bottom wall 414 (e.g., the upturned peripheral region 420 extends generally continuously around the bottom wall 414 of the ski 402, etc.) and is generally free of protrusions and obstructions. And together, the bottom wall 414 and the upturned peripheral region 420 provide the ski 402 with a generally circular (or disk) shape or footprint (when viewed in plan). In other exemplary embodiments, snow ski assemblies may include skis with bottom walls and peripheral regions defining other shapes or footprints (e.g., elliptical shapes, etc.) when the skis are viewed in plan. Further, it should be appreciated that a size (e.g., a length, etc.) of the upturned peripheral region 420 may vary, for example, to accommodate different movements and acrobatic possibilities by individuals using the ski 402.

The bottom wall 414 of the ski 402 (e.g., a central region of the ski 402, etc.) is also generally rounded from one peripheral region 420 of the ski 402 to another peripheral region 420 of the ski (e.g., as viewed in FIGS. 20 and 21), and is generally radially symmetric. In the illustrated embodiment, the rounded bottom wall 414 of the ski 402 is generally circular (or arc) shaped and extends/transitions smoothly to the upturned peripheral region 420 generally consistently (and symmetrically) around the perimeter of the ski 402 (such that, in this embodiment, the upturned peripheral region 420 is rounded and is an extension of the rounded bottom wall 414 and generally coincides with the bottom wall 414). However, the rounded bottom wall 414 may have other shapes, for example, generally near circular shapes, generally elliptical shapes, generally parabolic shapes, generally hyperbolic shapes, etc. and/or other geometries (e.g., asymmetric geometries, generally symmetric geometries that include asymmetries to help accommodate different movements and acrobatic possibilities, etc.) within the scope of the present disclosure (e.g., to help accommodate different movements and/or acrobatic possibilities using the snow ski assembly 400, etc.).

In use of the snow ski assembly 400 (i.e., when the snow ski assembly 400 is worn by the individual on one of the individual's feet), the bottom wall 414 (e.g., a bottom surface of the bottom wall 414, etc.) again engages the snow and/or ice during movement of the snow ski assembly 400. And, the upturned peripheral region 420 allows the ski 402 to move without interference from the snow and/or ice (e.g., without digging or biting into the snow and/or ice, etc.). Further, the shape of the ski 402 (as described above) and the positioning of the upturned peripheral region 420 around the entire periphery of the bottom wall 414 allows movement of the ski 402 in any direction, again without such interference from the snow and/or ice (e.g., without the peripheral region 420 of the ski 402 digging or biting into the snow and/or ice, etc.). However, it should again be appreciated that this does not infer that a user of the snow ski assembly 400 could not, by means of manipulation of his or her body, rotate (e.g., tip, tilt, etc.) the ski assembly 400 such that the upturned peripheral region 420 could be used for control if desired.

FIGS. 29-35 illustrate another exemplary embodiment of a snow ski assembly 500 according to the present disclosure. The snow ski assembly 500 of this embodiment is similar to the snow ski assembly 100 previously described and illustrated in FIGS. 1-7. For example, the snow ski assembly 500 of this embodiment is configured to be worn by an individual on one of the individual's feet, with a second snow ski assembly (e.g., another one of snow ski assembly 500, etc.) then configured to be worn by the individual on the individual's other foot. As such, the individual again uses two of the snow ski assemblies to travel (e.g., move, slide, etc.) across snow and/or ice as desired, for example, at a ski slope under the force of gravity, etc. Uniquely, the snow ski assembly 500 allows the individual to move in any direction across the snow and/or ice without preference for any one particular direction.

As shown in FIGS. 29-32, the snow ski assembly 500 of this embodiment again generally includes a ski 502, a mounting feature 504, and a binding 506. The binding 506 couples to the ski 502 at the mounting feature 504 and is configured to secure a boot 508 to the ski 502 so that the individual can wear the ski 502, via the boot 508 and binding 506, on one of the individual's feet. The illustrated binding 506 includes straps 510 that secure over, around, etc. the boot 508 to hold the boot 508 (and the individual's foot inside the boot 508) in the binding 506 (and, thus, the ski 502 on the individual's foot). In addition, it should again be appreciated that any suitable binding can be used with the snow ski assembly 500 within the scope of the present disclosure.

The mounting feature 504 of the snow ski assembly 500 includes multiple openings 512 defined in a bottom wall 514 of the ski 502. Fasteners 516 (e.g., screws, etc.) are configured to extend through openings in a lower portion of the binding 506, and into the corresponding openings 512, to couple the binding 506 to the mounting feature 504 (and to the ski 502). The position of the binding 506 on the ski 502 can be adjusted, as desired, by moving the fasteners 516 to different ones, or instances, of the openings 512 (which results in a different positioning of the binding 506 on the ski 502). In the illustrated embodiment, the mounting feature 504 includes twelve openings 512, arranged in four groups of three. And four fasteners 516 are used to couple the binding 506 to the mounting feature 504 (with one of the four fasteners 516 positioned in one of the openings 512 of each group, depending on desired positioning of the binding 506 on the ski 502). It should be appreciated that the mounting feature 504 may include a different number and/or arrangement of openings 512, and/or a different number of fasteners 516 may be used to couple the binding 506 to the mounting feature 504, for example, to accommodate different bindings, etc. In addition, in other exemplary embodiments, snow ski assemblies may include mounting features with structure other than openings (e.g., clips, straps, etc.) for use in coupling bindings to skis.

In this embodiment, the mounting feature 504 is again integrally defined by (e.g., monolithically formed with, etc.) the ski 502 of the snow ski assembly 500. However, as previously stated, in other exemplary embodiments, snow ski assemblies may include mounting features separate from skis and attached thereto.

With continued reference to FIGS. 29-32, the ski 502 of the snow ski assembly 500 is sized to receive the boot 508 generally within a footprint of the ski 502. In particular, the illustrated ski has a generally elliptical shape or footprint, with a dimension along a major axis (or transverse axis) of about sixteen inches and a dimension along a minor axis of about twelve inches for receiving the correspondingly sized boot 508 thereon. However, the ski 502 may be sized differently as desired (e.g., the ski 502 may have a dimension along the major axis of greater than or less than about sixteen inches and/or a dimension along the minor axis of greater than or less than about twelve inches, etc.), for example, to permit production of the ski 502 in a manner to accommodate different users having different foot sizes and, thus, different sizes of boots (e.g., ranging from youth to adult, etc.), as well as to accommodate different movements and acrobatic possibilities, etc. For example, in various embodiments, snow ski assemblies may include skis having elliptical shapes with dimensions along major and/or minor axes ranging anywhere from about four inches to about thirty-six inches, etc.

With additional reference now to FIGS. 33-35, the ski 502 of the snow ski assembly 500 generally includes the bottom wall 514 having an upturned peripheral region 520 (e.g., an upturned lip portion, an upturned peripheral portion located toward a perimeter of the bottom wall 514, an upturned sidewall, etc.). The upturned peripheral region 520 of the ski 502 generally extends around a peripheral portion (or perimeter portion) of the bottom wall 514 (e.g., the upturned peripheral region 520 extends generally continuously around the bottom wall 514 of the ski 502, etc.) and is generally free of protrusions and obstructions. Together, the bottom wall 514 and the upturned peripheral region 520 provide the ski 502 with the generally elliptical shape or footprint (when viewed in plan). In other exemplary embodiments, snow ski assemblies may include skis with bottom walls and peripheral regions defining other shapes (e.g., other than elliptical shapes, etc.) when the skis are viewed in plan. Further, it should be appreciated that a size (e.g., a length, etc.) of the upturned peripheral region 520 may vary, for example, to accommodate different movements and acrobatic possibilities by individuals using the ski 502.

The bottom wall 514 of the ski 502 (e.g., a central region of the ski 502, etc.) is generally flat (or planar), and is generally radially symmetric. And, the upturned peripheral region 520 of the ski 502 is generally flat (or linear) along a length of the peripheral region 520 from the flat bottom wall 514 to a perimeter edge of the ski 502. In the illustrated embodiment, the upturned peripheral region 520 forms an angle 522 with the flat bottom wall 514 of about twenty-five degrees (generally consistently around the perimeter of the ski 502). However, the angle 522 may be greater than or less than about twenty-five degrees, as desired (e.g., depending on desired movement of the ski 502 across snow and/or ice, etc.). In addition, in other exemplary embodiments, snow ski assemblies may include skis with bottom walls and/or peripheral regions having geometries, shapes, etc. that are other than generally flat and/or that are asymmetric and/or that include asymmetries (e.g., to help accommodate different movements and/or acrobatic possibilities using the snow ski assemblies, etc.). For example, in such embodiments, the bottom walls and/or the peripheral regions of the skis may include geometries, shapes, etc. that are generally rounded, etc.

In use of the snow ski assembly 500 (i.e., when the snow ski assembly 500 is worn by the individual on one of the individual's feet), the bottom wall 514 (e.g., a bottom surface of the bottom wall 514, etc.) engages the snow and/or ice during movement of the snow ski assembly 500. And, the upturned peripheral region 520 allows the ski 502 to move without interference from the snow and/or ice (e.g., without digging or biting into the snow and/or ice, etc.). Further, the shape of the ski 502 (as described above) and the positioning of the upturned peripheral region 520 around the entire peripheral portion of the bottom wall 514 allows movement of the ski 502 in any direction, again without such interference from the snow and/or ice (e.g., without the peripheral region 520 of the ski 502 digging or biting into the snow and/or ice, etc.). However, it should again be appreciated that this does not infer that a user of the snow ski assembly 500 could not, by means of manipulation of his or her body, rotate (e.g., tip, tilt, etc.) the ski assembly 500 such that the upturned peripheral region 520 could be used for control if desired.

In addition, in other exemplary embodiments where snow ski assemblies have skis with elliptical shapes (such as snow ski assembly 500), the skis may have bottom walls and/or peripheral regions having geometries, shapes, etc. that are other than generally flat and/or that are asymmetric and/or that include asymmetries (e.g., to help accommodate different movements and/or acrobatic possibilities using the snow ski assemblies, etc.). For example, in such embodiments, the bottom walls and/or the peripheral regions of the skis may include geometries, shapes, etc. that are generally rounded (e.g., generally circular shapes, generally near circular shapes, generally elliptical shapes, generally parabolic shapes, generally hyperbolic shapes, etc.), etc.

It should also be appreciated that snow ski assemblies having skis with elliptical shapes, such as snow ski assembly 500, in some embodiments, may also have configurations that include spacers (in similar fashion to the snow ski assemblies 200, 300, 400). The spacers may be separate from the skis, or integrally defined/formed with the skis.

In various exemplary embodiments of the present disclosure, the generally symmetric designs of the skis may allow for professional and amateur individuals to use the snow ski assemblies, as they will provide new opportunities for body movement and acrobatics that have not heretofore been possible with conventional snow skis and snowboards. In addition, it can be appreciated that individuals of all ages, sizes and skill levels can us the snow ski assemblies, and that such use may help teach balance and coordination while also making possible different body movements and acrobatics.

In various exemplary embodiments of the present disclosure, the snow ski assemblies are self-contained units that are generally easy to transport or convey to desired locations. In addition, the binding mounting features included with various exemplary embodiments of the snow ski assemblies can be of either universal type or, in some embodiments, proprietary type, enabling easy use of the snow ski assemblies with either generally available boots or with pre-existing equipment, as desired.

It should be appreciated that various components of snow ski assemblies of the present disclosure can be made from any desired suitable materials. For example, skis of the snow ski assemblies may be constructed from (without limitation) natural or man-made materials including, for example, metals, plastics, natural organic substances (e.g. wood, etc.), combinations thereof, etc.

Exemplary embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that exemplary embodiments may be embodied in many different forms, and that neither should be construed to limit the scope of the disclosure. In some exemplary embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9, and so forth.

The terminology used herein is for the purpose of describing particular exemplary embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the exemplary embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A snow ski assembly for use by an individual to slide across a snow covered surface, the snow ski assembly comprising:

a rigid ski having a bottom wall for engaging a snow covered surface and an upturned peripheral region extending completely around the bottom wall to help facilitate sliding movement of the ski across a snow covered surface in any direction, without preference to a particular direction, and to help inhibit the ski from digging into the snow covered surface when sliding across the snow covered surface, wherein the bottom wall and the upturned peripheral region are free of protrusions capable of engaging the snow covered surface when the ski is sliding across the snow covered surface;

a mounting feature disposed at a center portion of the ski for coupling a binding to the ski, such that an individual can position a foot in the binding and use the ski to slide across the snow covered surface; and a spacer associated with the mounting feature and configured to elevate the binding generally above the bottom wall of the ski.

2. The snow ski assembly of claim 1, wherein the ski defines a generally circular footprint.

3. The snow ski assembly of claim 2, wherein the bottom wall of the ski includes a diameter of between about four inches and about thirty-six inches.

4. The snow ski assembly of claim 1, wherein the ski defines a generally elliptical footprint.

5. The snow ski assembly of claim 4, wherein the bottom wall of the ski includes a transverse of between about four inches and about thirty-six inches.

6. The snow ski assembly of claim 1, wherein the mounting feature is integral with the bottom wall of the ski.

7. The snow ski assembly of claim 6, wherein the mounting feature includes multiple openings for use in coupling the binding to the bottom wall of the ski, the openings disposed in the bottom wall of the ski.

8. The snow ski assembly of claim 1, wherein the mounting feature is integral with the spacer and the spacer is integral with the ski; and wherein the mounting feature includes multiple openings for use in coupling the binding to the ski via the spacer, the openings disposed in the spacer.

9. The snow ski assembly of claim 1, wherein the bottom wall of the ski is generally planar.

10. The snow ski assembly of claim 9, wherein the upturned peripheral region is oriented at an angle relative to the bottom wall.

11. The snow ski assembly of claim 1, wherein the bottom wall of the ski defines a generally rounded cross section.

12. The snow ski assembly of claim 11, wherein the upturned peripheral region generally coincides with the generally rounded cross section of the bottom wall.

13. The snow ski assembly of claim 1, further comprising the binding.

14. A snow ski for use by an individual to slide across a snow covered surface, the snow ski comprising:

a rigid bottom wall for engaging a snow covered surface, wherein the bottom wall defines a generally circular footprint;

an upturned peripheral region extending around the bottom wall to help facilitate sliding movement of the snow ski across a snow covered surface in any direction and to help inhibit the snow ski from digging into the snow covered surface when sliding across the snow covered surface;

a mounting feature disposed along a central axis of the snow ski for use in positioning a foot of an individual on the snow ski, so that the individual can stand on the snow ski and slide across a snow covered surface under the force of gravity; and a spacer configured to support the individual's foot on the ski generally above the bottom wall, the mounting feature integral with the spacer;

wherein the bottom wall and the upturned peripheral region are free of protrusions capable of engaging the snow covered surface when the snow ski is sliding across the snow covered surface, and wherein the upturned peripheral region extends generally continuously around the bottom wall and is free of obstructions.

15. The snow ski of claim 14, wherein the bottom wall is generally planar; and wherein the upturned peripheral region is oriented at an angle relative to the bottom wall.

16. The snow ski of claim 14, wherein the bottom wall defines a generally rounded cross section; and wherein the upturned peripheral region defines a generally rounded cross section that coincides with the generally rounded cross section of the bottom wall.

17. A snow ski for use by an individual to slide across a snow covered surface, the snow ski comprising:

a rigid bottom wall for engaging a snow covered surface, wherein the bottom wall defines a generally elliptical footprint;

an upturned peripheral region extending around the bottom wall to help facilitate sliding movement of the snow ski across a snow covered surface in any direction and to help inhibit the snow ski from digging into the snow covered surface when sliding across the snow covered surface;

a mounting feature disposed along a central axis of the snow ski for use in positioning a foot of an individual on the snow ski, so that the individual can stand on the snow ski and slide across a snow covered surface under the force of gravity; and a spacer configured to support the individual's foot on the ski generally above the bottom wall, the mounting feature integral with the spacer;

wherein the bottom wall and the upturned peripheral region are free of protrusions capable of engaging the snow covered surface when the snow ski is sliding across the snow covered surface, and wherein the upturned peripheral region extends generally continuously around the bottom wall and is free of obstructions.

18. The snow ski of claim 17, wherein the bottom wall is generally planar; and wherein the upturned peripheral region is oriented at an angle relative to the bottom wall.

19. The snow ski of claim 17, wherein the bottom wall defines a generally rounded cross section; and wherein the upturned peripheral region defines a generally rounded cross section that coincides with the generally rounded cross section of the bottom wall.

* * * * *